US009434196B2

(12) United States Patent
Fukasawa et al.

(10) Patent No.: US 9,434,196 B2
(45) Date of Patent: Sep. 6, 2016

(54) PRINTING APPARATUS AND PRINTING METHOD

(71) Applicant: CANON KABUSHIKI KAISHA, Tokyo (JP)

(72) Inventors: Takuya Fukasawa, Kawasaki (JP); Yoshiaki Murayama, Tokyo (JP); Satoshi Azuma, Kawasaki (JP); Minoru Teshigawara, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 13/905,270

(22) Filed: May 30, 2013

(65) Prior Publication Data

US 2013/0329144 A1 Dec. 12, 2013

(30) Foreign Application Priority Data

Jun. 8, 2012 (JP) ..... 2012-131391

(51) Int. Cl.
*B41J 2/21* (2006.01)
*B41J 29/393* (2006.01)

(52) U.S. Cl.
CPC ..... *B41J 29/393* (2013.01); *B41J 2/2142* (2013.01); *B41J 2/2146* (2013.01); *B41J 2029/3935* (2013.01)

(58) Field of Classification Search
CPC ..... B41J 29/393; B41J 2/0451; B41J 2/165; B41J 2/16579; B41J 2029/3935
See application file for complete search history.

(56) References Cited

U.S. PATENT DOCUMENTS

| | | | | |
|---|---|---|---|---|
| 5,398,053 | A | 3/1995 | Hirosawa et al. | |
| 7,334,859 | B2 * | 2/2008 | Kojima | B41J 2/2139 347/19 |
| 7,594,709 | B2 * | 9/2009 | Kojima | B41J 2/2139 347/19 |
| 7,708,371 | B2 | 5/2010 | Yamanobe | |
| 2011/0211011 | A1 * | 9/2011 | Hoshi et al. | 347/19 |
| 2011/0211892 | A1 | 9/2011 | Yasuzaki | |
| 2012/0114188 | A1 * | 5/2012 | Murase et al. | 382/112 |
| 2012/0194587 | A1 | 8/2012 | Teshigawara et al. | |
| 2013/0100189 | A1 * | 4/2013 | Azuma | B41J 2/16579 347/14 |
| 2013/0100193 | A1 * | 4/2013 | Hoshi | B41J 2/2142 347/16 |

FOREIGN PATENT DOCUMENTS

| | | |
|---|---|---|
| JP | 2-276647 A | 11/1990 |
| JP | 2931784 B2 | 8/1999 |

(Continued)

OTHER PUBLICATIONS

Zeisho Kazuya, JP2011-137736, machine translation.*

(Continued)

*Primary Examiner* — An Do
*Assistant Examiner* — Renee I Wilson
(74) *Attorney, Agent, or Firm* — Fitzpatrick, Cella, Harper & Scinto

(57) ABSTRACT

Printed products can be efficiently sorted into non-defective ones and defective ones even when a discharge failure occurs during the printing operation. Two inspection patterns for detecting discharge failure are printed before and after a plurality of images. The inspection patterns are read to determine the type of discharge failure. Printed media are sorted based on whether it is determined that there is a continuous discharge failure, whether it is determined that there is an accidental discharge failure, or whether it is determined that the discharge is normal.

20 Claims, 19 Drawing Sheets

(56) References Cited

FOREIGN PATENT DOCUMENTS

| | | | |
|---|---|---|---|
| JP | 2006-205742 | A | 8/2006 |
| JP | 2007-76167 | A | 3/2007 |
| JP | 2008-188840 | A | 8/2008 |
| JP | 2009-34987 | A | 2/2009 |
| JP | 2009-78399 | A | 4/2009 |
| JP | 2009-154408 | A | 7/2009 |
| JP | 2011-137736 | A | 7/2011 |
| JP | 2011-177905 | A | 9/2011 |
| JP | 2011-194627 | A | 10/2011 |
| JP | 2012-51183 | A | 3/2012 |

OTHER PUBLICATIONS

Office Action dated Aug. 2, 2013, in Japanese Application No. 2012-131391.

* cited by examiner

FIG. 6
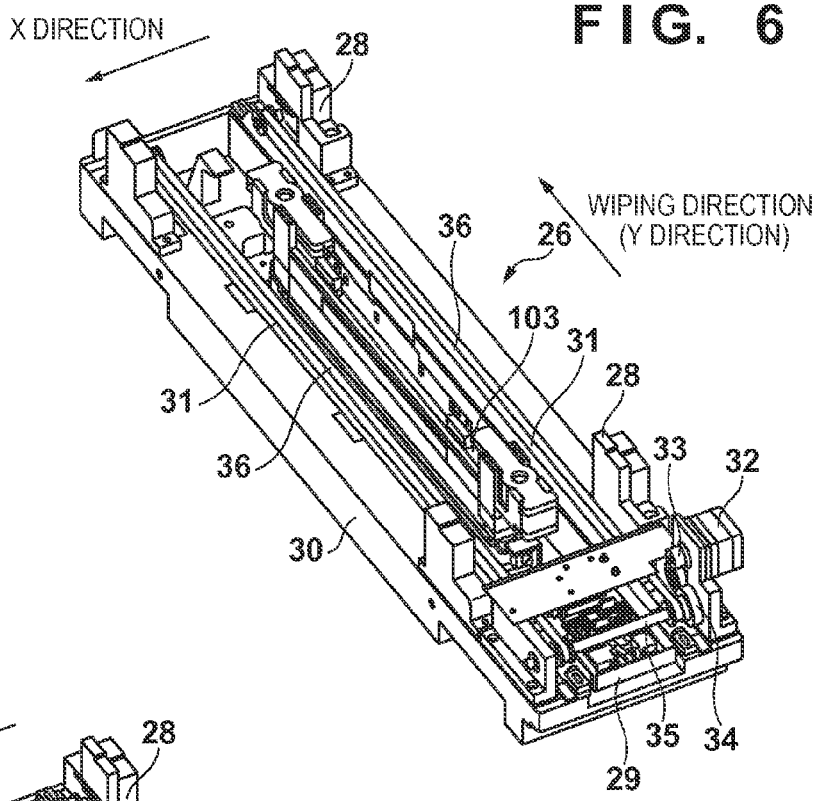
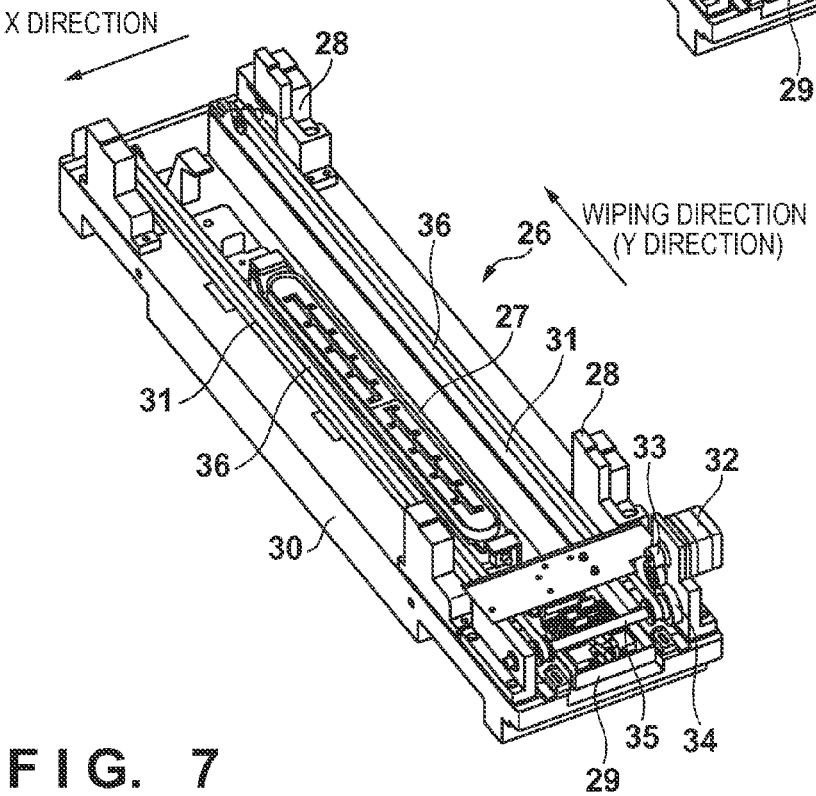
FIG. 7

PRINTING APPARATUS AND PRINTING METHOD

BACKGROUND OF THE INVENTION

1. Field of the Invention

The present invention relates to a printing apparatus and printing method and, particularly to a printing apparatus including an inkjet full-line head and a method for sorting print media printed by the apparatus.

2. Description of the Related Art

In general, an inkjet printing apparatus (to be referred to as a printing apparatus hereinafter) prints an ink dot by attaching ink as a droplet to a print medium such as paper. Recently, the technological advance of arrayed nozzle integration enables the manufacture of a high-density, long print width printhead. Such a printhead is generally called a full-line printhead, and can complete an image by one printing scan in a wide printing region corresponding to the printhead.

As the print width of the head becomes longer and the nozzle density becomes higher, the number of nozzles tends to increase. As the number of ink types used increases, the total number of nozzles also increases. In some apparatuses, the total number of nozzles becomes several tens of thousands or several hundreds of thousands. However, a larger number of nozzles make it difficult to completely manage the states of the respective nozzles and keep the discharge states of all nozzles normal. Many factors which disturb normal ink discharge are conceivable, including attachment of dust such as paper dust or dirt to the vicinity of the nozzle, attachment of ink mist, an increase in ink viscosity, mixing of air bubbles and dust into ink, and a nozzle failure.

These factors results a discharge failure such as an ink discharge failure or discharge warp, causing an image printing problem such as generation of a stripe. If such a discharge failure occurs during the printing operation, it needs to be detected quickly. However, if the printing apparatus is stopped and recovery such as suction is performed, time is taken until the printing operation is restarted, decreasing the printing efficiency. This arouses demand for confirming printed products later depending on the state of a discharge failure so that they can be sorted into non-defectives and defectives, and continuing the printing operation itself.

To solve these problems, for example, Japanese Patent No. 2931784 discloses a method of, when the printing state is determined to be improper, overlaying and printing a predetermined image on a printed image to substantially invalidate the printed image, accumulating the printed product in the same stacker as that for normal printed products, continuing the printing operation.

Discharge failures that occurred during the printing operation include an accidental discharge failure which is naturally recovered within a short period of time even if it occurs, and a discharge failure which continues once it occurs. For example, even if a discharge failure occurred by an air bubble in ink, the air bubble may be discharged from the orifice depending on the type and size of air bubble, and the discharge failure may be recovered in a short period of time. Also, even if dust is attached to a nozzle and a discharge failure occurs, the dust may be naturally removed depending on the type and size of dust, and the discharge failure is naturally recovered in a short period of time.

Depending on a print image, even if a discharge failure occurs in regard to an ink among a plurality of inks used in the printhead, a normal printed product may be output. For example, in an image in which the density change of each color component is complicated, a problem such as density unevenness arising from a discharge failure is not easily visually recognizable, and the printed product is easily acceptable as a normal one, compared to a case in which the density of a print image is hardly changed and an image is printed at a uniform density. Hence, when a continuous discharge failure occurs, a printed product in which degradation of the image quality is visually recognized is highly likely to be output soon or later. However, when an accidental discharge failure which will be naturally recovered in a short period of time occurs, non-defective printed products and defective printed products may be output and coexist before and after the occurrence of the discharge failure. In this case, it is better to select only non-defective printed products from the output printed products.

However, in a case where the quality of a printed product is accurately determined automatically by an apparatus for each print image, the apparatus control becomes complicated, and it becomes difficult to perform the control at high accuracy. In a situation in which non-defective printed products and visually recognizable defective printed products coexist, the operator may want to reliably make a final judgment by visual check. Also, when a discharge failure is detected, the method disclosed in Japanese Patent No. 2931784 overlays and prints an image representing a defective on a printed product. Even if this method can reduce the apparatus stop time, it wastes a non-defective printed product as a defective.

SUMMARY OF THE INVENTION

Accordingly, the present invention is conceived as a response to the above-described disadvantages of the conventional art.

For example, a printing apparatus and printing method according to this invention are capable of efficiently sorting printed products into non-defective ones and defective ones even when a discharge failure occurs during the printing operation.

According to one aspect of the present invention, there is provided a printing apparatus comprising: a printhead for discharging ink; a control unit configured to print in order, on a print medium by the printhead, a first inspection pattern for inspecting the printhead, a plurality of images, and a second inspection pattern for inspecting the printhead; and a reading unit configured to read the first inspection pattern and the second inspection pattern, wherein the control unit is configured to determine a state of the printed plurality of images based on a reading result by the reading unit, wherein the state is one of:

(i) a first state in which it is estimated that no discharge failure has occurred in all the plurality of images;

(ii) a second state in which it is estimated that discharge failure has occurred in all the plurality of images; and (iii) a third state in which it is estimated that images in which discharge failure has occurred and images in which no discharge failure has occurred coexist.

According to another aspect of the present invention, there is provided a method for printing with a printhead for discharging ink, comprising: printing in order, on a print medium by the printhead, a first inspection pattern for inspecting the printhead, a plurality of images, and a second inspection pattern for inspecting the printhead; reading the first inspection pattern and the second inspection pattern; and determining a state of the printed plurality of images based on a result of reading, wherein the state is one of:

(i) a first state in which it is estimated that no discharge failure has occurred in all the plurality of images;

(ii) a second state in which it is estimated that discharge failure has occurred in all the plurality of images; and (iii) a third state in which it is estimated that images in which discharge failure has occurred and images in which no discharge failure has occurred coexist.

The invention is particularly advantageous since printed products can be efficiently sorted into non-defective ones and defective ones even when a discharge failure occurs during the printing operation.

Further features of the present invention will become apparent from the following description of exemplary embodiments (with reference to the attached drawings).

BRIEF DESCRIPTION OF THE DRAWINGS

FIG. 6 is a perspective view showing the arrangement of a cleaning mechanism.

FIG. 7 is a perspective view showing the arrangement of the cleaning mechanism.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

A printhead substrate (head substrate) used below means not merely a base made of a silicon semiconductor, but an arrangement in which elements, wiring lines, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

Next, an embodiment of an inkjet printing apparatus will be explained. The printing apparatus is a high-speed line printer which uses a rolled continuous sheet (print medium) and copes with both single-sided printing and double-sided printing. The printing apparatus is suitable for a massive amount of printing in a printing laboratory and the like.

Figure 1:
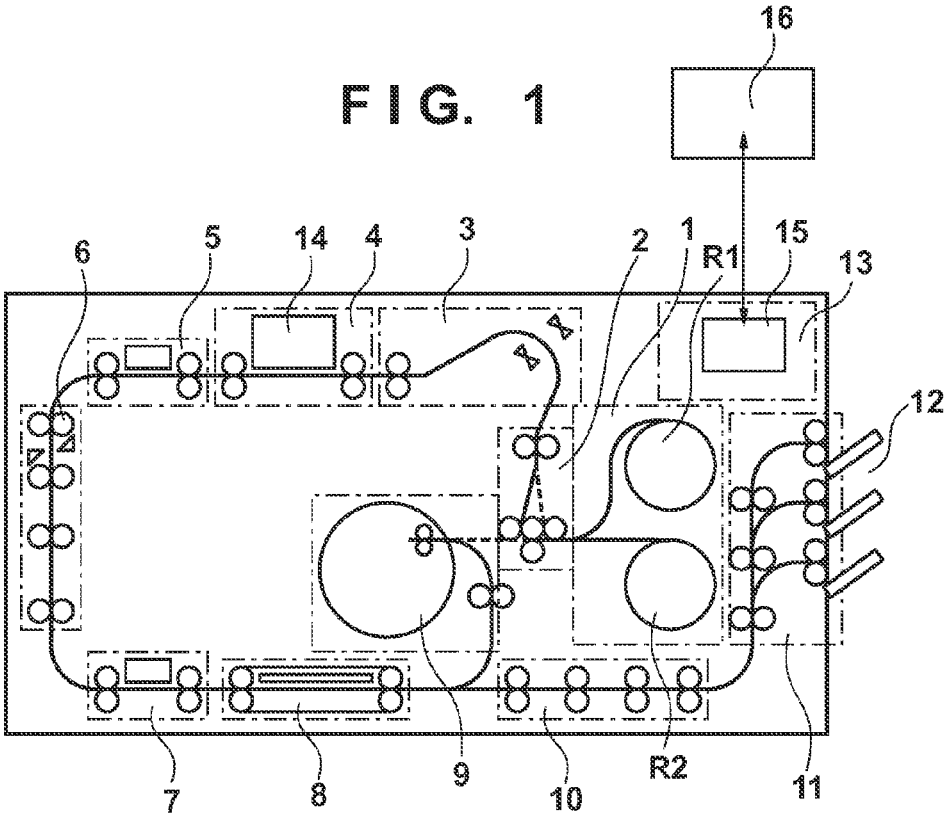
FIG. 1 is a schematic side sectional view showing the internal arrangement of an inkjet printing apparatus as an exemplary embodiment of the present invention.

FIG. 1 is a side sectional view showing the schematic internal arrangement of an inkjet printing apparatus (to be referred to as a printing apparatus hereinafter) as an exemplary embodiment of the present invention. The inside of the apparatus is roughly divided into a sheet supply unit 1, decurl unit 2, skewed conveyance adjustment unit 3, print unit 4, cleaning unit (not shown), inspection unit 5, cutter unit 6, information print unit 7, drying unit 8, sheet take-up unit 9, discharge conveyance unit 10, sorter unit 11, discharge tray 12, and control unit 13. A sheet is conveyed by a conveyance mechanism, including a roller pair and belt, along a sheet conveyance path indicated by a solid line in FIG. 1, and processed by the respective units.

The sheet supply unit 1 stores and supplies a rolled continuous sheet. The sheet supply unit 1 can store two rolls R1 and R2, and selectively pulls out and supplies a sheet.

Note that the number of storable rolls is not limited to two, and the sheet supply unit 1 may store one or three or more rolls. The decurl unit 2 reduces a curl (warp) of a sheet supplied from the sheet supply unit 1. The decurl unit 2 reduces a curl by bending and squeezing a sheet to give an opposite warp using two pinch rollers for one driving roller. The skewed conveyance adjustment unit 3 adjusts a skew (inclination with respect to the original traveling direction) of the sheet having passed through the decurl unit 2. The skewed conveyance adjustment unit 3 adjusts a skew of the sheet by pressing a sheet end on the reference side against a guide member.

The print unit 4 prints an image on the conveyed sheet by using a printhead unit 14. The print unit 4 includes a plurality of conveyance rollers for conveying a sheet. The printhead unit 14 includes a full-line printhead (inkjet full-line head) on which an inkjet nozzle array is formed in a range covering the maximum width of a sheet assumed to be used. In the printhead unit 14, a plurality of printheads are arranged parallelly in the sheet conveyance direction. The printhead unit 14 in the embodiment includes four printheads corresponding to four colors K (blacK), C (Cyan), M (Magenta), and Y (Yellow). The printheads are aligned in the order of K, C, M, and Y from the upstream side of the sheet conveyance direction. The number of ink colors and that of printheads are not limited to four. The inkjet method can be a method using a heating element, a method using a piezoelectric element, a method using an electrostatic element, or a method using a MEMS element. Inks of the respective colors are supplied from ink tanks to the printhead unit 14 via ink tubes.

The inspection unit 5 optically reads an inspection pattern or image printed on a sheet by the print unit 4, and inspects the nozzle state of the printhead, the sheet conveyance state, the image position, and the like. The inspection unit 5 includes a scanner unit which actually reads an image and generates image data, and an image analysis unit which analyzes the read image and transmits the analysis result to the print unit 4. The inspection unit 5 is a CCD line sensor, and sensors are aligned in a direction perpendicular to the sheet conveyance direction.

Figure 2:
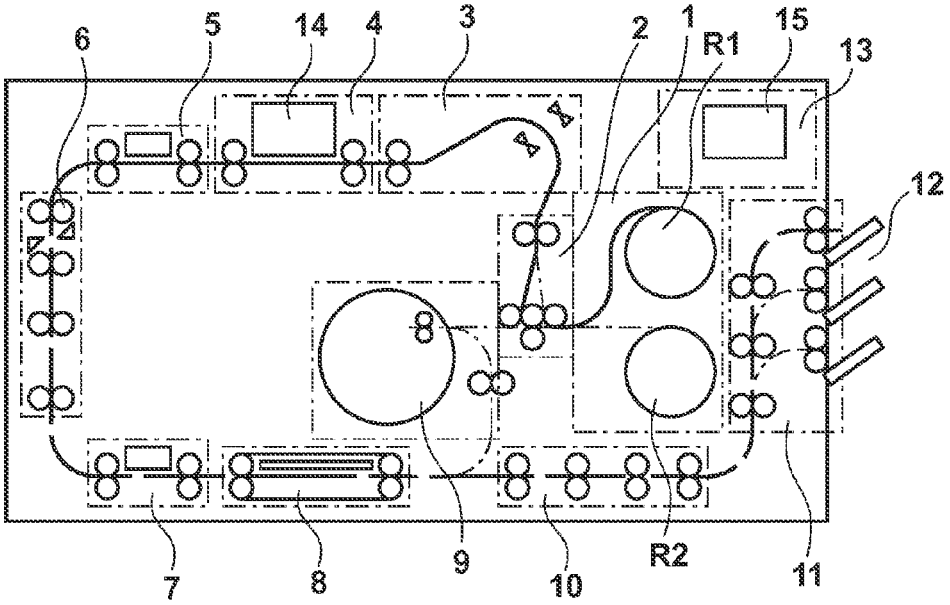
FIG. 2 is a view for explaining an operation in single-sided printing in the printing apparatus shown in FIG. 1.
Figure 3:
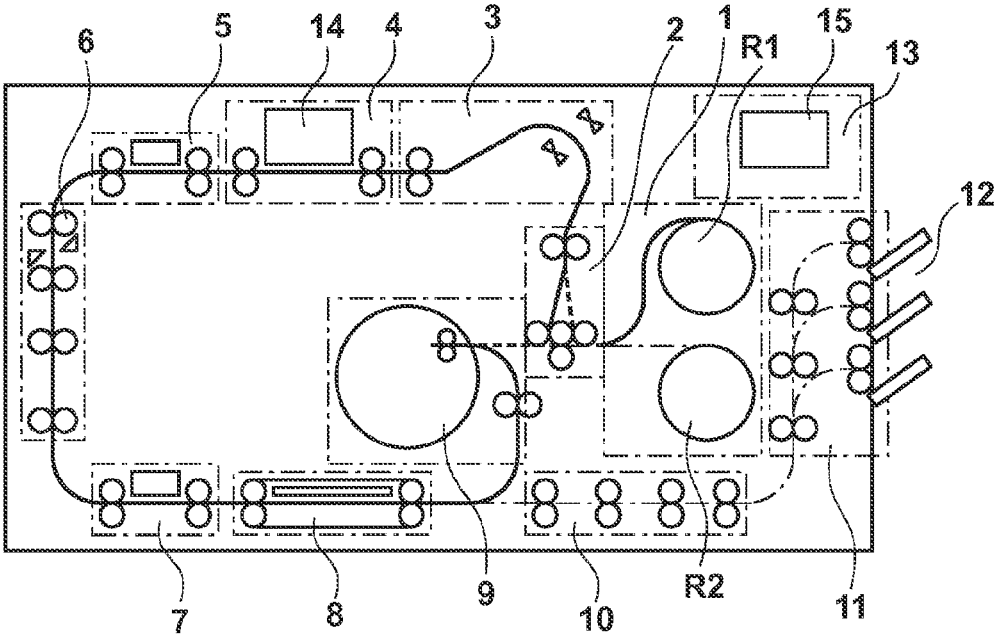
FIG. 3 is a view for explaining an operation in double-sided printing in the printing apparatus shown in FIG. 1.

As described above, the printing apparatus shown in FIG. 1 copes with both single-sided printing and double-sided printing. FIGS. 2 and 3 are views for explaining an operation in single-sided printing and an operation in double-sided printing in the printing apparatus shown in FIG. 1, respectively.

Figure 4:
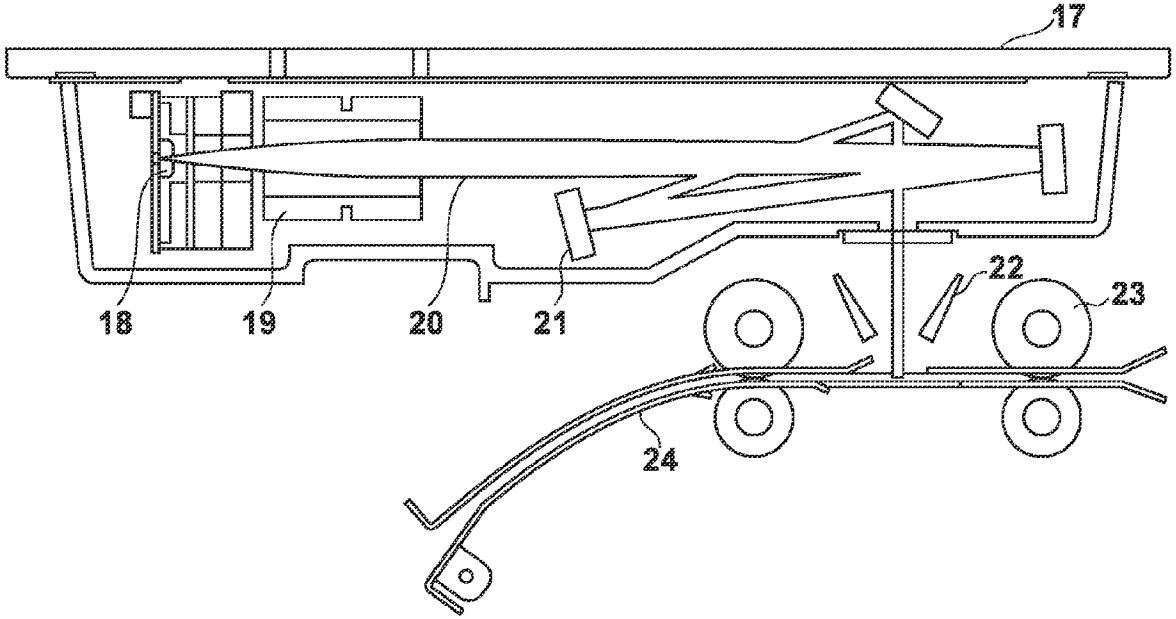
FIG. 4 is a view showing an outline of a scanner unit.

FIG. 4 is a side sectional view showing the detailed arrangement of the scanner unit.

A scanner unit 17 includes a CCD 18 for converting light into an electrical signal, a lens 19, mirrors 21 for deflecting a ray 20 in a narrow space, an original illuminator 22 for illuminating an original, conveyance rollers 23 for conveying an original, and a paper conveyance guide plate 24 for guiding an original. The ray 20 indicates an optical path extending to the CCD 18 through the lens 19 after reflection by an original.

An original guided by the paper conveyance guide plate 24 passes through a reading unit at a predetermined speed by the conveyance rollers 23. The original illuminator 22 irradiates the original at the reading unit. Light from the irradiated original is deflected by the mirrors 21, and collected to the CCD 18 through the lens 19. Image information converted into an electrical signal by the CCD 18 is delivered to the image analysis unit, and analyzed. The inspection unit 5 includes an analysis CPU (not shown).

The cutter unit 6 includes a mechanical cutter which cuts a printed sheet into a predetermined length. The cutter unit 6 also includes a plurality of conveyance rollers for supplying a sheet to the next process. The information print unit 7 prints printing information such as a serial number and date on the reverse surface of a cut sheet. The drying unit 8 heats a sheet printed by the print unit 4 to dry applied ink within a short period of time. The drying unit 8 includes a conveyance belt and conveyance roller for supplying a sheet to the next process.

When performing double-sided printing, the sheet take-up unit 9 temporarily takes up a continuous sheet having undergone face printing. The sheet take-up unit 9 includes a take-up drum which rotates to take up a sheet. The take-up drum temporarily takes up the continuous sheet which has not been cut after the end of face printing. After the end of take-up, the take-up drum rotates reversely, and the taken-up sheet is supplied to the decurl unit 2 and then fed to the print unit 4. Since the sheet has been turned over, the print unit 4 can perform reverse face printing. A more detailed operation in double-sided printing will be described later.

The discharge conveyance unit 10 conveys a sheet which has been cut by the cutter unit 6 and dried by the drying unit 8, and delivers it to the sorter unit 11. If necessary, the sorter unit 11 sorts and discharges printed sheets to different trays of the discharge tray 12 for respective groups. FIGS. 1 to 3 show three trays as the discharge tray 12, and these trays will be called the first tray, second tray, and third tray from the top.

In the following description, the positions of the first and second trays are physically fixed. As another method, the first to third trays may be discriminated to make their positions changeable. For example, lamps may be attached to the trays so that the first to third trays can be discriminated by the lighting colors of the lamps. Particularly when there are four or more trays, it is also possible to make the positions of the first and second trays changeable, and sort and discharge printed products to different discharge trays for respective groups.

The control unit 13 controls the respective units of the overall printing apparatus. The control unit 13 includes a controller 15 including a CPU, memory, and various I/O interfaces, and a power supply. The operation of the printing apparatus is controlled based on an instruction from the controller 15 or an external device 16 such as a host computer (to be referred to as a host hereinafter) connected to the controller 15 via an I/O interface.

Next, a basic printing operation will be described. The printing operation differs between single-sided printing and double-sided printing, and the respective operations will be explained.

FIG. 2 is a view for explaining an operation in single-sided printing.

In FIG. 2, a thick line indicates a conveyance path until a sheet is discharged to the discharge tray 12 after an image is printed on the sheet supplied from the sheet supply unit 1. The print unit 4 performs face printing (single-sided printing) on a sheet which has been supplied from the sheet supply unit 1 and processed by the decurl unit 2 and skewed conveyance adjustment unit 3. The printed sheet passes through the inspection unit 5, and is cut into a predetermined unit length by the cutter unit 6. If necessary, the information print unit 7 prints printing information on the reverse face of the cut sheet. Cut sheets are conveyed one by one to the drying unit 8 and dried. Then, the dried sheets are sequentially discharged to and stacked on the tray 12 of the sorter unit 11 via the discharge conveyance unit 10.

FIG. 3 is a view for explaining an operation in double-sided printing.

In double-sided printing, a reverse face printing sequence is executed subsequently to the face printing sequence. In the first face printing sequence, the operations of the respective units including the sheet supply unit 1 to the inspection unit 5 are the same as those in single-sided printing described above. In double-sided printing, the cutter unit 6 does not perform the cutting operation, and the sheet is conveyed as a continuous sheet to the drying unit 8. After the drying unit 8 dries ink on the face, the sheet is guided not to a path on the side of the discharge conveyance unit 10 but a path on the side of the sheet take-up unit 9. The guided sheet is taken up by the take-up drum of the sheet take-up unit 9 which rotates in the forward direction (counterclockwise in FIG. 3). After the end of printing on the predetermined face by the print unit 4, the cutter unit 6 cuts the trailing end of the continuous sheet in the printing region. The continuous sheet on the downstream side (side on which printing has been done) in the conveyance direction with respect to the cut position passes through the drying unit 8 and is entirely taken up to the trailing end (cut position) of the sheet by the sheet take-up unit 9. The continuous sheet on the upstream side in the conveyance direction from the cut position is wound back by the sheet supply unit 1 so that the leading end (cut position) of the sheet does not remain in the decurl unit 2.

After the face printing sequence, the printing operation switches to the reverse face printing sequence. The take-up drum of the sheet take-up unit 9 rotates in the backward direction (clockwise in FIG. 3) opposite to take-up. The end of the taken-up sheet (the trailing end of the sheet in take-up serves as the leading end of the sheet in feeding) is fed to the decurl unit 2. The decurl unit 2 corrects the curl in a direction opposite to the previous one. This is because the sheet is wound around the take-up drum so that its face and reverse face are turned over from the roll in the sheet supply unit 1, and the sheet has a reverse curl. After the sheet passes through the skewed conveyance adjustment unit 3, the print unit 4 prints on the reverse face of the continuous sheet. After passing through the inspection unit 5, the printed sheet is cut into a predetermined unit length by the cutter unit 6. Since the two faces of the cut sheet are printed, the information print unit 7 does not print. Cut sheets are discharged one by one to the drying unit 8, pass through the discharge conveyance unit 10, and are sequentially discharged and stacked on the tray 12 of the sorter unit 11.

Next, the structure of the printhead unit 14 will be explained in more detail.

Figure 5:
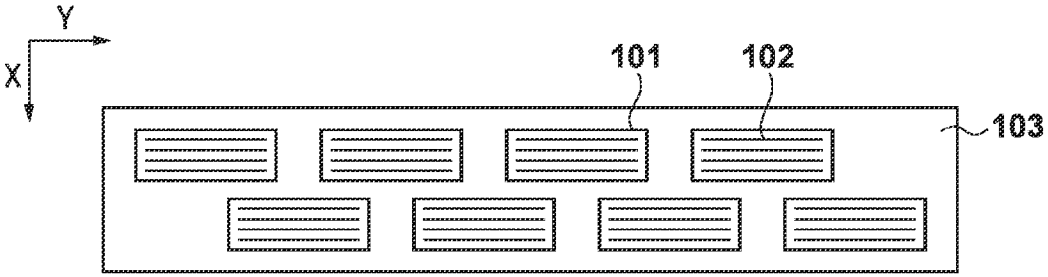
FIG. 5 is a view showing an outline of a printhead.

The printhead unit 14 in the embodiment is formed from printheads of four colors K (blacK), C (Cyan), M (Magenta), and Y (Yellow). The respective printheads have the same arrangement, and FIG. 5 shows the arrangement of the printhead.

On a printhead 103, eight silicon chips 101 each having an effective discharge width of about 1 inch are adhered in a staggered pattern to a lower base substrate serving as a support member. Each chip 101 is electrically connected at electrodes at two ends to a flexible wiring board by wire bonding. The chips 101 overlap each other by a predetermined number of nozzles. Each chip 101 is formed from four, nozzle array A, nozzle array B, nozzle array C, and nozzle array D. A temperature sensor (not shown) which measures a chip temperature is attached to the chip 101.

The printhead 103 is an inkjet printhead having an effective discharge width of about 8 inches. This width substantially coincides with the length of the short side of A4-print paper, and enables continuous printing by one pass when A4-print paper is conveyed in the longitudinal direction. In the embodiment, identical inkjet printheads are arranged for the respective colors to enable full-color printing.

In an actual printing operation, a plurality of orifices (nozzles) 102 are formed to discharge liquid to the surface side of the chip 101 near the center. Printing is performed by an ink droplet discharged from each orifice 102. A heating element (electrothermal transducer or heater) (not shown) is formed as a discharge energy generation element on the chip 101 in correspondence with each orifice 102. The heating element bubbles ink by heating it, and discharges it from the orifice 102 by the kinetic energy.

Although the embodiment uses the CCD line sensor as the inspection unit, the inspection unit is not limited to this. The nozzle array resolution is 1,200 dpi, and the inter-nozzle resolution is 2,400 dpi, but the resolutions are not limited to them.

Next, the cleaning mechanism will be explained in more detail.

FIGS. 6 and 7 are perspective views showing the detailed arrangement of the cleaning unit and one cleaning mechanism 26.

The cleaning unit includes a plurality of (four) cleaning mechanisms 26 in correspondence with a plurality of (four) printheads 103. FIG. 6 shows a state (in the cleaning operation) in which the printhead 103 exists on the cleaning mechanism 26. FIG. 7 shows a state in which no printhead exists on the cleaning mechanism 26.

The cleaning unit includes the cleaning mechanism 26, a cap 27, and a positioning member 28. The cleaning mechanism 26 includes a wiper unit 29 which removes a deposit to the nozzle surface (ink discharge surface) of the printhead 103, a moving mechanism which moves the wiper unit 29 in the wiping direction (Y direction), and a frame 30 which integrally supports them. A driving source drives the moving mechanism to move, in the Y direction, the wiper unit 29 guided and supported by two shafts 31. The driving source includes a driving motor 32, and reduction gears 33 and 34, and rotates a driving shaft 35. The rotation of the driving shaft 35 is transmitted by a belt 36 and a pulley to move the wiper unit 29.

Figure 8:
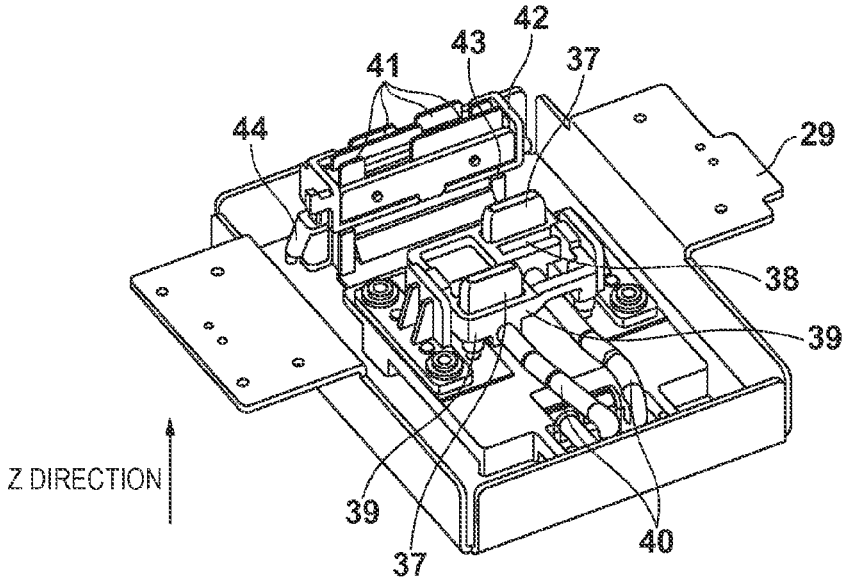
FIG. 8 is a view showing the arrangement of a wiper unit.

FIG. 8 is a view showing the arrangement of the wiper unit 29. The wiper unit 29 includes two suction ports 37 in correspondence with nozzle chip arrays. The two suction ports 37 have the same interval as that between two nozzle chip arrays in the X direction. The two suction ports 37 have almost the same shift amount as the shift amount (predetermined distance) between adjacent nozzle chips of two nozzle chip arrays in the Y direction. The suction ports 37 are held by a suction holder 38. The suction holder 38 is biased by a spring 39 serving as an elastic member in a direction (Z direction) perpendicular to the nozzle surface of the printhead unit 14, and can move in the Z direction against the spring. This displacement mechanism absorbs a motion when the suction port 37 crosses a sealing portion during movement.

Tubes 40 are connected to the two suction ports 37 via the suction holder 38, and a negative pressure generation unit such as a suction pump is connected to the tubes 40. When the negative pressure generation unit operates, a negative pressure is applied inside the suction ports 37 to suck ink and dust. In this way, ink and dust are sucked from the ink orifices of the printhead. A blade holder 42 holds two blades 41 on each of the right and left sides, that is, a total of four blades. The blade holder 42 is supported at two ends in the X direction, and can rotate about a rotation axis in the X direction. The blade holder 42 is normally biased against a stopper 43 by a spring 44. The blade 41 can change the orientation of the blade surface between a wiping position and a retraction position in accordance with the operation of a switching mechanism. The suction holder 38 and blade holder 42 are set on a common support member of the wiper unit 29.

Next, a discharge failure monitoring function to be executed by the printing apparatus having the above arrangement will be explained.

The discharge failure monitoring function is a function of detecting a discharge failure occurred during the printing operation.

Figure 9:
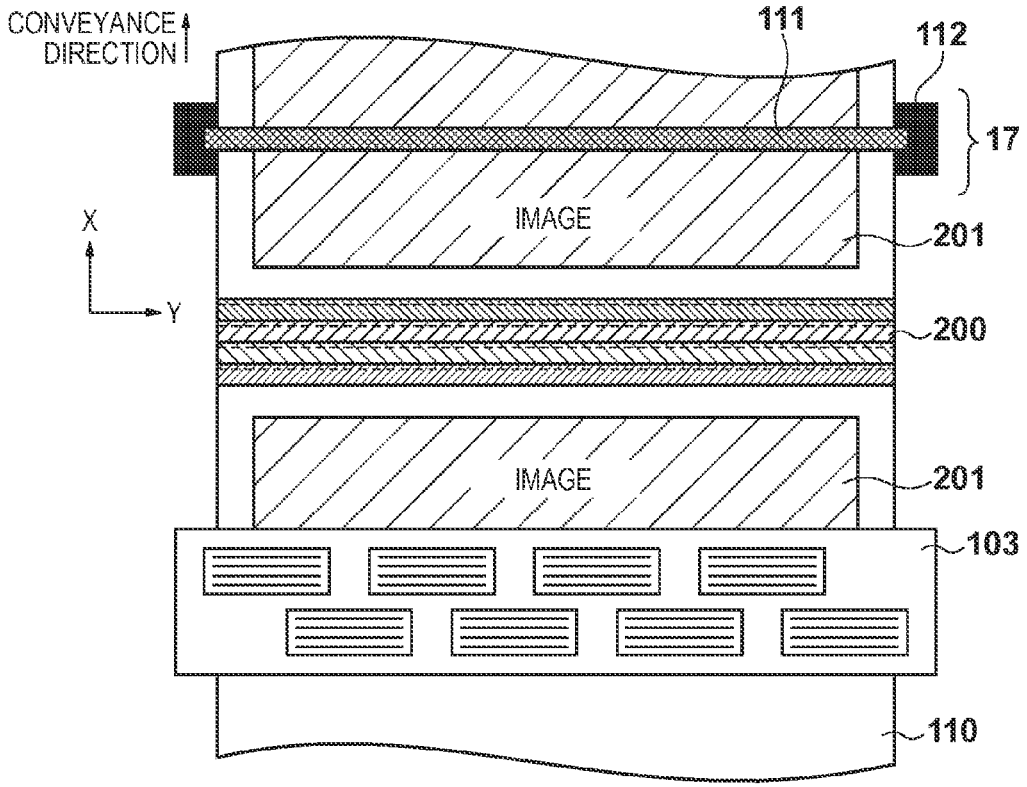
FIG. 9 is a view showing an outline of the positional relationship between the printhead, the scanner unit, and a discharge failure monitoring pattern.

FIG. 9 is a schematic view showing the positional relationship between the printhead 103, the scanner unit 17, an image 201, and a discharge failure monitoring pattern 200.

While a print medium 110 is conveyed from the bottom (upstream side) to the top (downstream side) in FIG. 9, the printhead 103 prints the image 201 and discharge failure monitoring pattern 200 during one paper conveyance. The discharge failure monitoring pattern 200 can be printed at any desired interval between images. In FIG. 9, reference numeral 111 schematically denotes a region (scanner reading region) where the CCD of the scanner unit 17 can read an image; and 112, a scanner background which is entirely filled in black in order to reduce the influence of fogging near the paper end. While passing through the scanner reading region 111, the discharge failure monitoring pattern is read by the scanner unit. The read data is transferred to the CPU to perform analysis about a discharge failure nozzle.

Next, the discharge failure monitoring function will be explained with reference to a flowchart.

Figure 10:
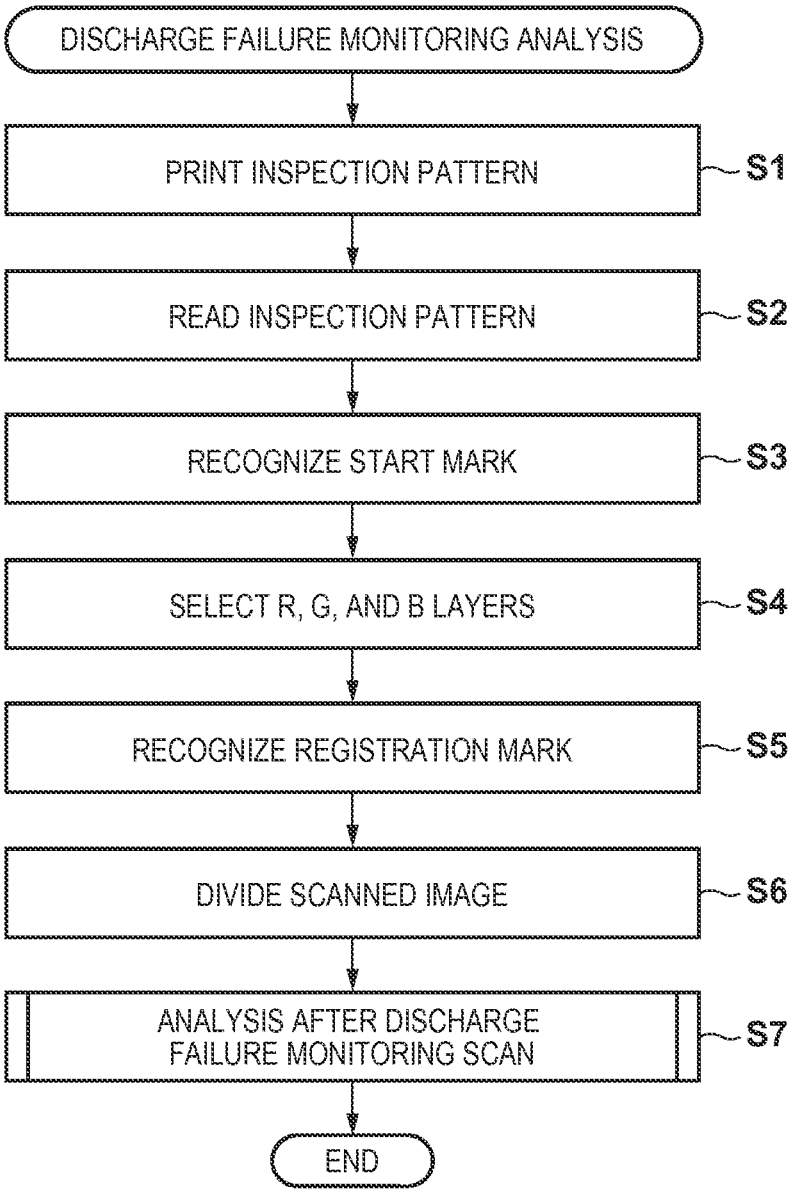
FIG. 10 is a flowchart for explaining a discharge failure monitoring function.

FIG. 10 is a flowchart showing discharge failure monitoring processing.

In step S1, a discharge failure monitoring pattern (inspection pattern) is printed between images. Assume that the discharge failure monitoring pattern is printed by an ink of one color (Bk) for descriptive convenience.

Figure 11:
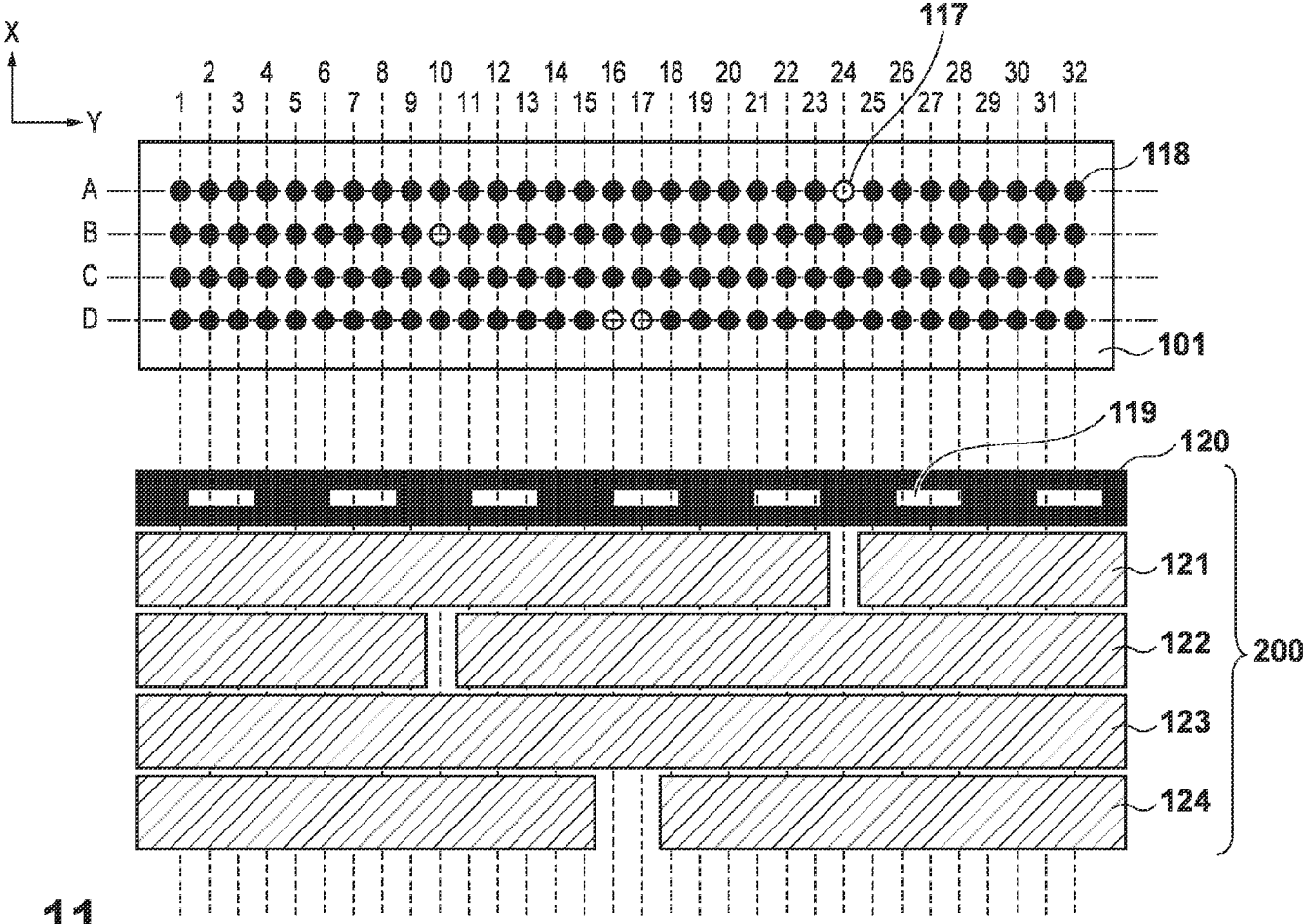
FIG. 11 is a view showing the relationship between the printhead and the discharge failure monitoring pattern upon occurrence of a discharge failure.

FIG. 11 is a view showing the relationship between the printhead and the discharge failure monitoring pattern. FIG. 11 exemplifies a discharge failure monitoring pattern (inspection pattern) printed by 32 nozzles at the center of one chip 101 in the printhead 103. The chip 101 has a resolution of 1,200 dpi in the nozzle array direction (Y direction), and is formed from four arrays A to D in the conveyance direction (X direction).

The discharge failure monitoring pattern 200 is formed from start marks 119, a registration mark 120, an array A inspection pattern 121, an array B inspection pattern 122, an array C inspection pattern 123, and an array D inspection pattern 124. The start marks 119 are used to specify the start position of the inspection pattern in a read image in discharge failure nozzle analysis, and also used for preliminary discharge of each nozzle array. The registration mark 120 is blank and is used to specify the rough position of a discharge failure nozzle. Note that the start marks 119 are printed using all the nozzle arrays to reduce the influence of the presence of a discharge failure nozzle even though such a discharge failure exists.

In FIG. 11, reference numerals 117 and 118 denote a discharge failure nozzle (open circle) and discharge nozzle (filled circle). In FIG. 11, the 24th nozzle of array A, the 10th nozzle of array B, and the 16th and 17th nozzles of array D are discharge failure nozzles. In FIG. 11, portions of the discharge failure monitoring pattern 200 that are printed by the discharge failure nozzles of these arrays become blank. Also, when a deviation in ink discharge other than a discharge failure occurs, a corresponding portion of the inspection pattern becomes blank similarly. When the deviation amount exceeds a predetermined amount, the deviation can be handled similarly to the discharge failure.

Referring back to FIG. 10, in step S2, while the print medium is kept conveyed, the scanner unit reads the discharge failure monitoring pattern (inspection pattern) printed between images. The reading resolution of the reading unit is selectively set from a plurality of modes. In step S2, the reading resolution is set to 400 dpi in this case, and reading is performed.

The start marks are recognized in step S3, and R (Red), G (Green), and B (Blue) layers used in analysis for respective ink types are selected in step S4. More specifically, Bk and M inspection patterns are analyzed using the G layer, a C inspection pattern is analyzed using the R layer, and a Y inspection pattern is analyzed using the B layer.

In step S5, the registration mark is recognized to specify the rough position of a nozzle with respect to the read image. In step S6, the scanned image is divided into respective ink colors and respective nozzle arrays.

Finally, in step S7, analysis after discharge failure monitoring scan is performed for the divided images. Then, the discharge failure monitoring processing ends. In this manner, whether there is a discharge failure nozzle in the printhead can be confirmed based on the discharge failure monitoring pattern.

Several embodiments of analysis after discharge failure monitoring scan to be executed by the printing apparatus having the above arrangement will be described below.

First Embodiment

Figure 12:
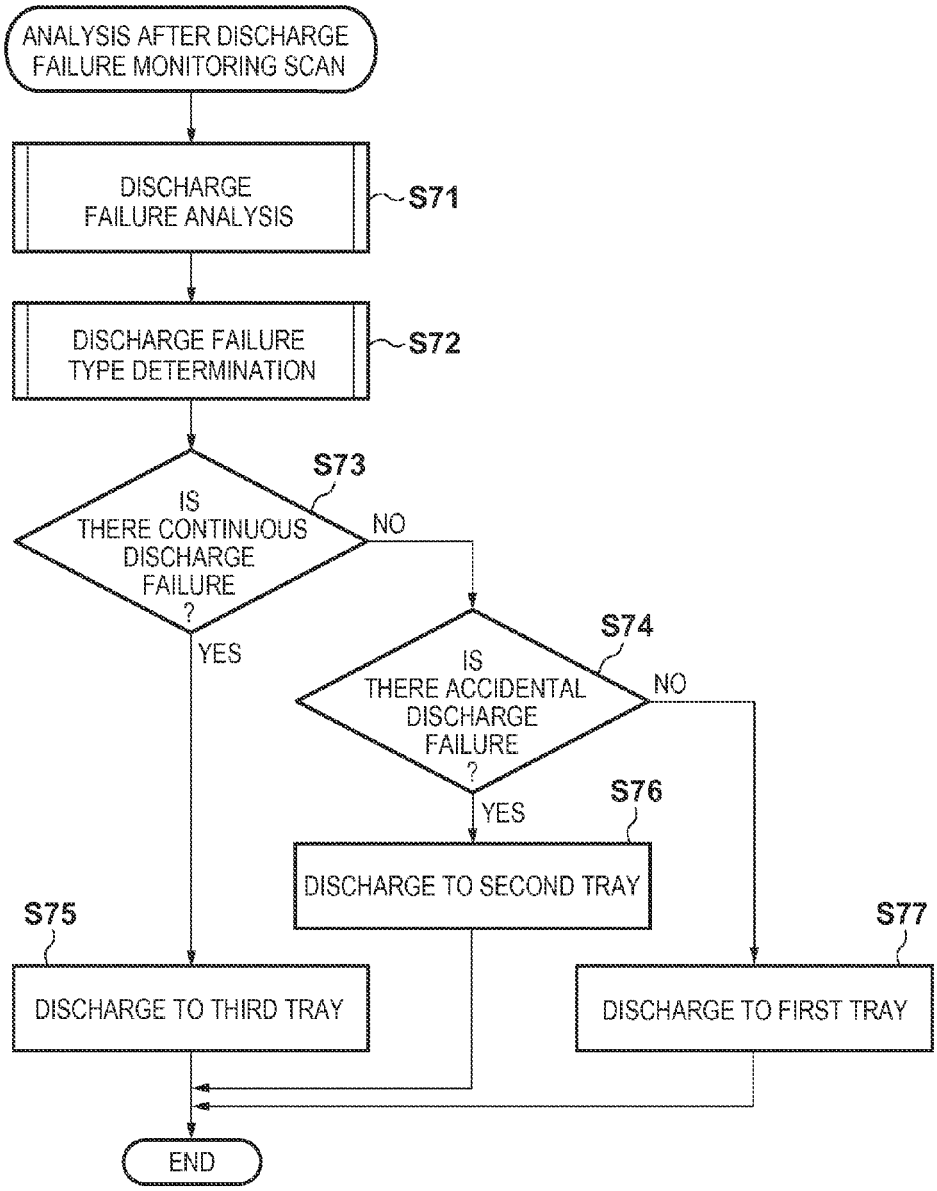
FIG. 12 is a flowchart showing analysis processing after discharge failure monitoring scan according to the first embodiment.

FIG. 12 is a flowchart showing analysis processing after discharge failure monitoring scan according to the first embodiment. In step S71, discharge failure analysis for detecting a discharge failure or deviation is executed as the analysis after discharge failure monitoring scan. More specifically, whether there is a discharge failure nozzle in the printhead is confirmed based on two successive discharge failure monitoring patterns. In step S72, whether there is a continuous discharge failure is checked for the discharge failure analysis result.

If it is determined that a discharge failure has occurred in the analysis results of the two successive discharge failure monitoring patterns, it is determined in step S73 that a discharge failure which will continue once occurred is likely to have occurred (continuous discharge failure). The process advances to step S75 to discharge a printed product to the third tray. That is, it is estimated that the discharge failure is likely to have occurred in all images between the two successive discharge failure monitoring patterns. To the contrary, if it is determined that no discharge failure has occurred in the analysis results of the two successive discharge failure monitoring patterns, it is determined that there is no continuous discharge failure, and the process advances to step S74. If it is determined that a discharge failure has occurred in the analysis result of either of the two successive discharge failure monitoring patterns, it is determined in step S74 that a discharge failure which will be naturally recovered in a short period of time even if the failure have occurred is likely to have occurred (accidental discharge failure), and the process advances to step S76 to discharge a printed product to the second tray. That is, it is estimated that normal images and images in which a discharge failure has occurred are likely to coexist in a plurality of images between the two successive discharge failure monitoring patterns. If NO in steps S73 and S74 (it is determined that no discharge failure has occurred in the analysis results of the two successive discharge failure monitoring patterns), the process advances to step S77 to discharge a printed product to the first tray. That is, it is estimated that no discharge failure has occurred in all images between the two successive discharge failure monitoring patterns.

Printed products to be output to the first to third trays will be explained.

Figure 13:
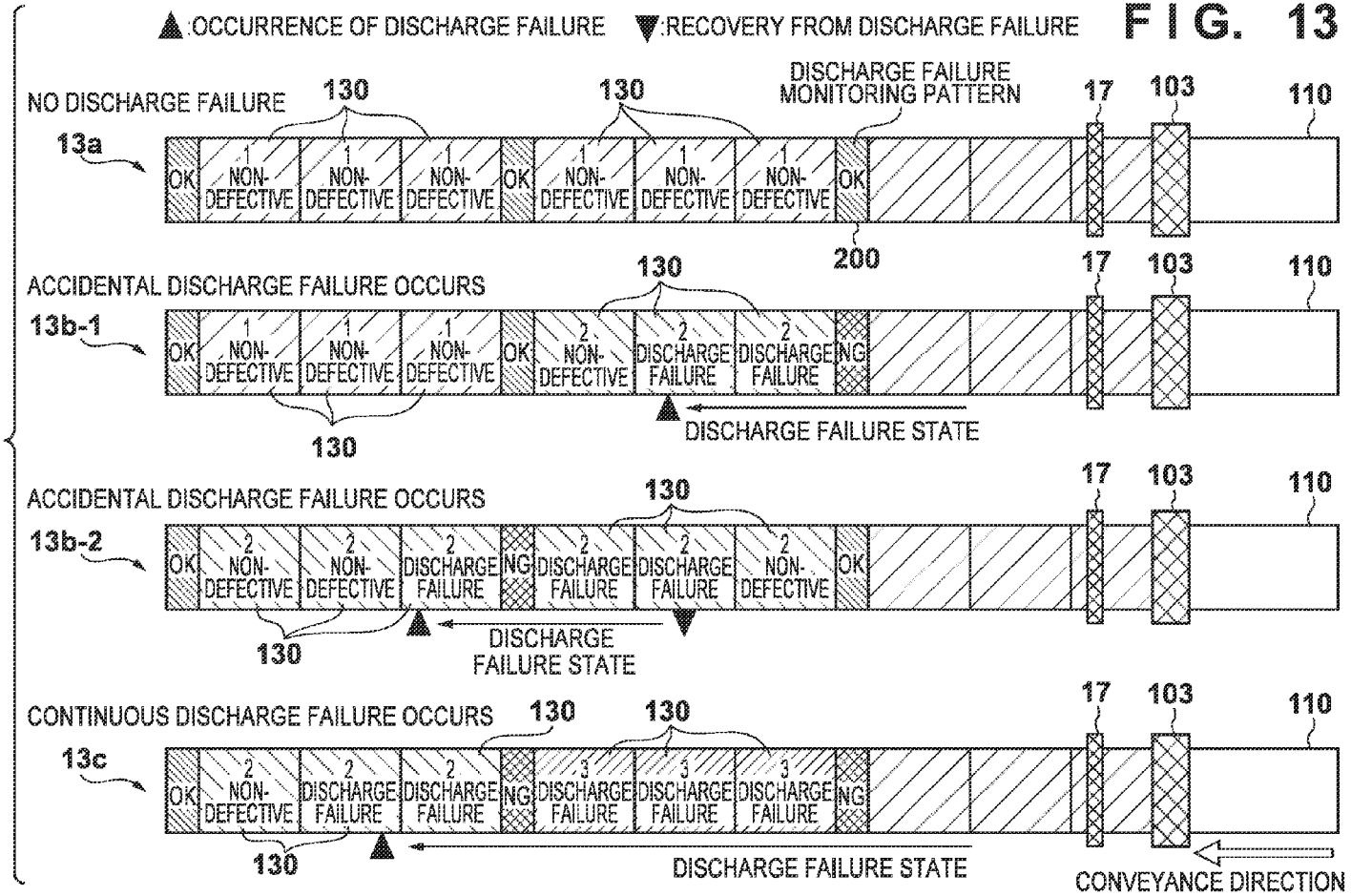
FIG. 13 is a view for explaining a state in which printed products are discriminated into non-defective printed products and defective printed products during the printing operation.

FIG. 13 is a schematic view showing a state in which, while a print medium 110 is conveyed left, a printhead 103 prints, and a scanner unit 17 reads a discharge failure monitoring pattern 200 between images.

In FIG. 13, 13*a* represents a case in which it is estimated that there is no discharge failure. 13*b*-1 represents a case in which it is estimated that an accidental discharge failure has occurred. 13*b*-2 represents a case in which it is estimated that an accidental discharge failure occurred and was naturally recovered. 13*c* represents a case in which it is estimated that a continuous discharge failure has occurred. In each of these views, each of six printed products 130 represents the number of a tray to which the printed product 130 is output, and the state of the printed product 130. More specifically, number "1" indicates the first tray, number "2" indicates the second tray, and number "3" indicates the third tray. States of a printed product are "non-defective" representing high quality, and "discharge failure" representing poor quality.

Each case will be explained in detail below.

In "13*a*", occurrence of a discharge failure is not detected in the discharge failure monitoring pattern. It is therefore determined that the first to sixth printed products are non-defectives. The first to sixth printed products are discharged to the first tray.

In "13*b*-1", it is estimated from the analysis result of the discharge failure monitoring patterns that a discharge failure has occurred during printing of the fourth to sixth printed products. Thus, it is determined that the first to third printed products are non-defectives. The first to third printed products are discharged to the first tray, and the fourth to sixth printed products in which non-defective images and images in which a discharge failure has occurred are likely to coexist are discharged to the second tray.

In "13*b*-2", it is estimated from the analysis result of the discharge failure monitoring patterns that a discharge failure occurred during printing of the first to third printed products. However, it is considered that the discharge failure was naturally recovered during printing of the fourth to sixth printed products. The first to sixth printed products, in which printing was performed in the discharge failure state, and non-defective printed products and printed products in which a discharge failure occurred are likely to coexist, are discharged to the second tray.

In "13*c*", it is estimated from the analysis result of the discharge failure monitoring patterns that a discharge failure has occurred during printing of the first to third printed products. Hence, the first to third printed products, in which printing was performed in the discharge failure state, and non-defective printed products and printed products in which a discharge failure occurred are likely to coexist, are discharged to the second tray. The fourth to sixth printed products, which are estimated as printed products in which printing was performed in the discharge failure state and a discharge failure occurred, are discharged to the third tray.

By the above operation, normal printed products are discharged to the first tray. Print products including both normal printed products, and products printed in the discharge failure state are discharged to the second tray. Products printed in the discharge failure state are discharged to the third tray. By only confirming the second tray, the user can efficiently sort printed products into normal printed products and poor-quality printed products.

Next, the analysis completion timing of analysis after discharge failure monitoring scan and the timing of a discharge tray branch instruction will be explained. The discharge failure monitoring pattern 200 can be printed at any desired interval between images, and in the following example, is printed at an interval of 20 sec.

Analysis after discharge failure monitoring scan according to the first embodiment uses the discharge failure analysis results of two successive printed products. First, it takes 20 sec to print the second discharge failure monitoring pattern. Further, it takes 4 sec to complete reading by the scanner unit after printing the discharge failure monitoring pattern. Discharge failure analysis and discharge failure type determination take 2 sec. Hence, it takes a total of 26 sec from the start of printing the discharge failure monitoring pattern necessary for analysis through discharge failure analysis up to determination of a discharge tray to which a printed product is discharged.

Conveyance takes 30 sec until a printed product immediately after the discharge failure monitoring pattern is printed and reaches a sorter unit 11 which branches the discharge tray. Thus, the branch of the discharge tray can be determined 4 sec (=30 sec−26 sec) before a printed product immediately after a preceding discharge failure monitoring pattern in the conveyance direction out of the two discharge failure monitoring patterns reaches the sorter unit 11. The branch of the discharge tray as described above can be implemented in accordance with the analysis result.

Here, the discharge failure monitoring pattern printing interval is 20 sec. However, the printing interval may be intentionally changed in accordance with the positional relationship between the printhead and the scanner unit, the processing speed, or a desired resolution as long as discharge failure analysis is completed before a printed product immediately after a preceding discharge failure monitoring pattern reaches the sorter unit 11. By shortening the discharge failure monitoring pattern printing interval, the discharge tray can be branched more finely.

Under the above-described conditions, the discharge failure monitoring pattern printing timing can be advanced once a discharge failure is detected. In this case, the printing state can be grasped in more detail.

Details of the discharge failure analysis (step S71) in the above-described analysis after discharge failure monitoring scan will be explained with reference to a flowchart.

Discharge Failure Analysis: Analysis Unit (Step S71)

Figure 14:
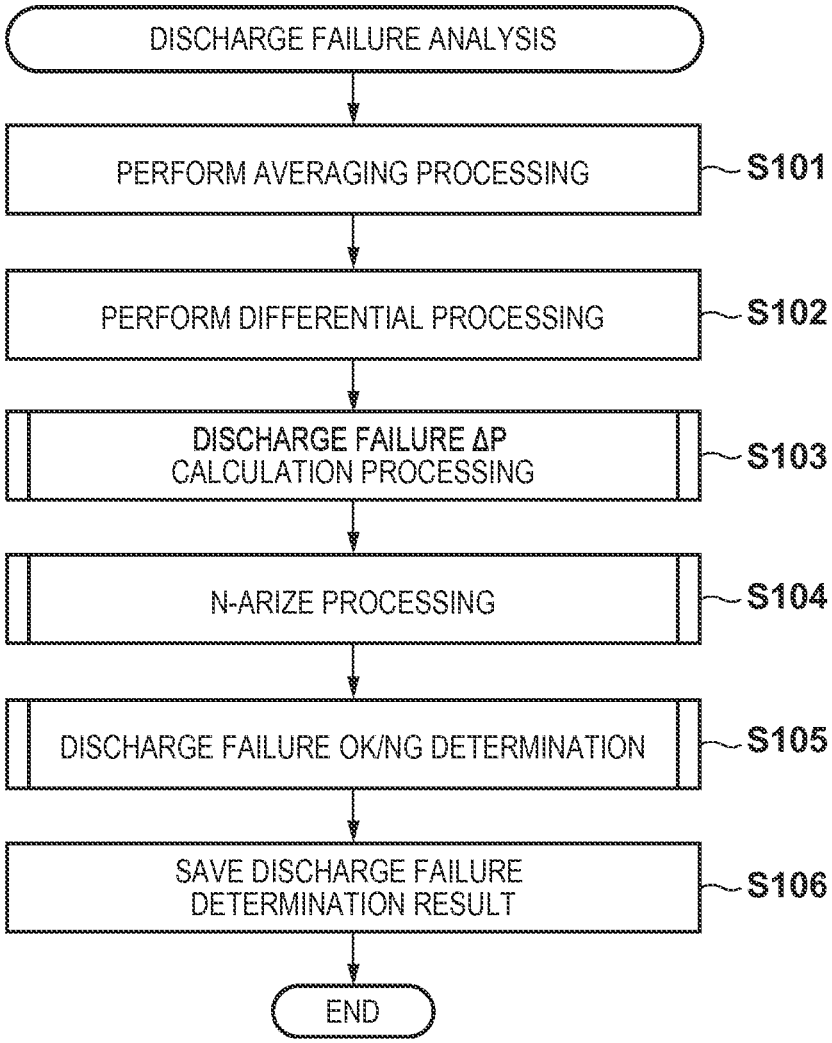
FIG. 14 is a flowchart showing discharge failure analysis processing.

FIG. 14 is a flowchart showing detailed processing of discharge failure analysis in the analysis after discharge failure monitoring scan.

In step S101, images divided in step S6 undergo averaging processing in the sheet conveyance direction to reduce noise. In the embodiment, averaging processing of the brightness values of predetermined R, G, and B layers is performed for six pixels at the center of the inspection pattern of each nozzle array. The averaged brightness value will be called a "raw value".

In step S102, differential processing is performed for the calculated raw value in the nozzle array direction. The differential processing is defined as adding a differential value to the Nth pixel:

$$\text{differential value}=\{(\text{brightness value of } (N+d)\text{th pixel})-(\text{brightness value of } N\text{th pixel})\}/2$$

d: differential distance

Figure 15:
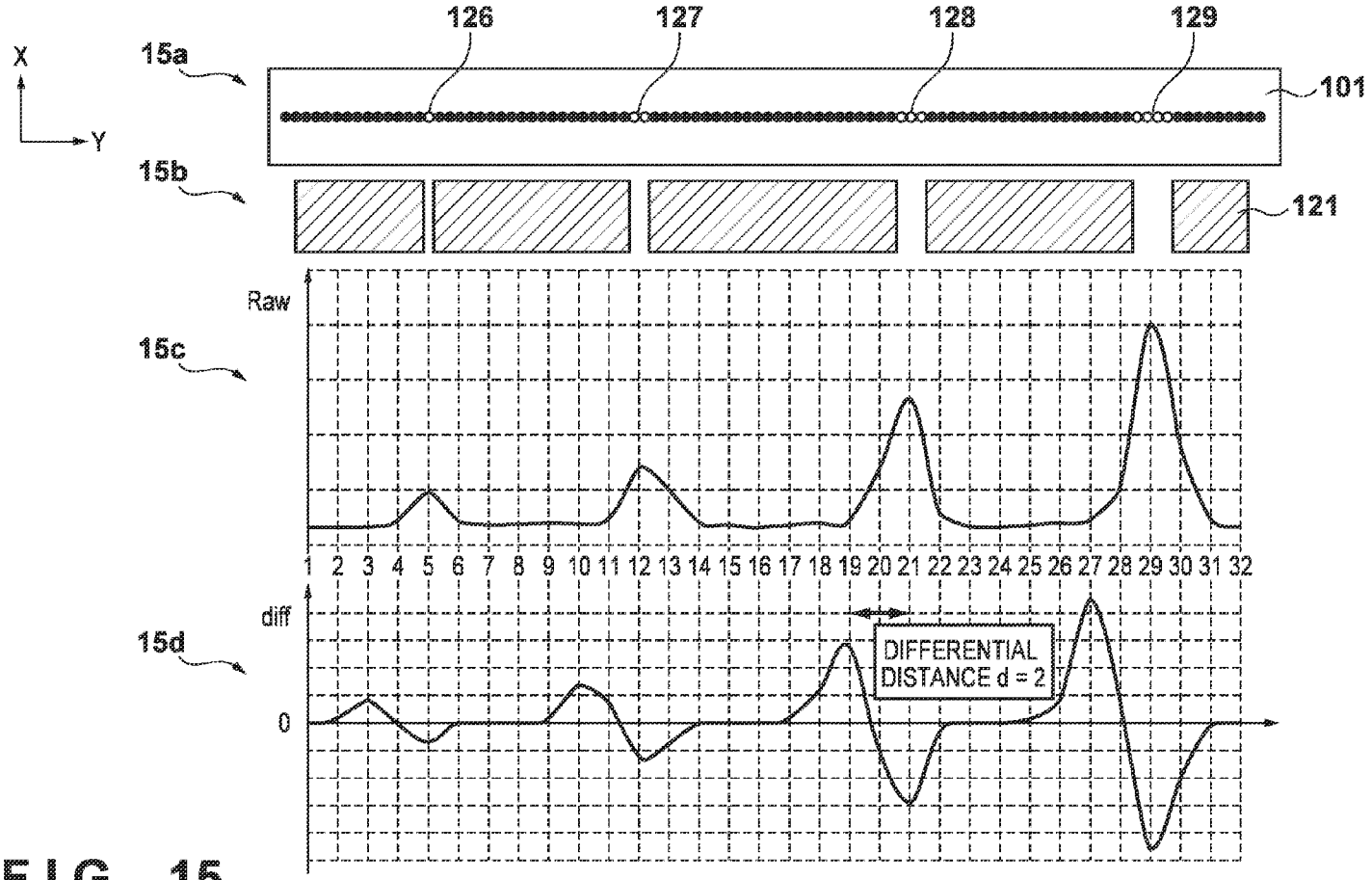
FIG. 15 is a view for explaining the relationship between an inspection pattern, a raw value, and a differential value upon occurrence of a discharge failure.

FIG. 15 is a view showing an outline of the relationship between the chip 101 and the discharge failure monitoring pattern 200. For descriptive convenience, one nozzle array will be exemplified.

In FIG. 15, 15*a* shows only array A of the chip 101, and represents a state in which there are one discharge failure nozzle 126, two consecutive discharge failure nozzles 127, three consecutive discharge failure nozzles 128, and four consecutive discharge failure nozzles 129. In FIG. 15, 15*b* shows only the array A inspection pattern 121 of the discharge failure monitoring pattern 200, and portions corresponding to the discharge failure nozzles become blank. In FIG. 15, 15*c* shows a raw value "Raw" calculated in step S101. The abscissa indicates the pixel position of an image, and the ordinate indicates the brightness value. In FIG. 15, 15*d* shows a value "diff" calculated by the differential processing in step S102, and will be called a differential value. Note that the differential distance (d) is 2 pixels in differential processing in this discharge failure analysis.

The differential processing has two purposes. The first purpose is to reduce the influence, on discharge failure detection, of the brightness distribution of the scanner unit in the nozzle array direction and the density distribution of the discharge failure monitoring pattern in the nozzle array direction. The second purpose is to increase the S/N ratio. That is, the differential processing can reduce the influence of an offset from the average value, and increase the discharge failure nozzle detection accuracy.

In step S103, the peak difference "discharge failure ΔP" of the differential value is calculated to estimate the number of discharge failure nozzles within pixels.

Figure 16:
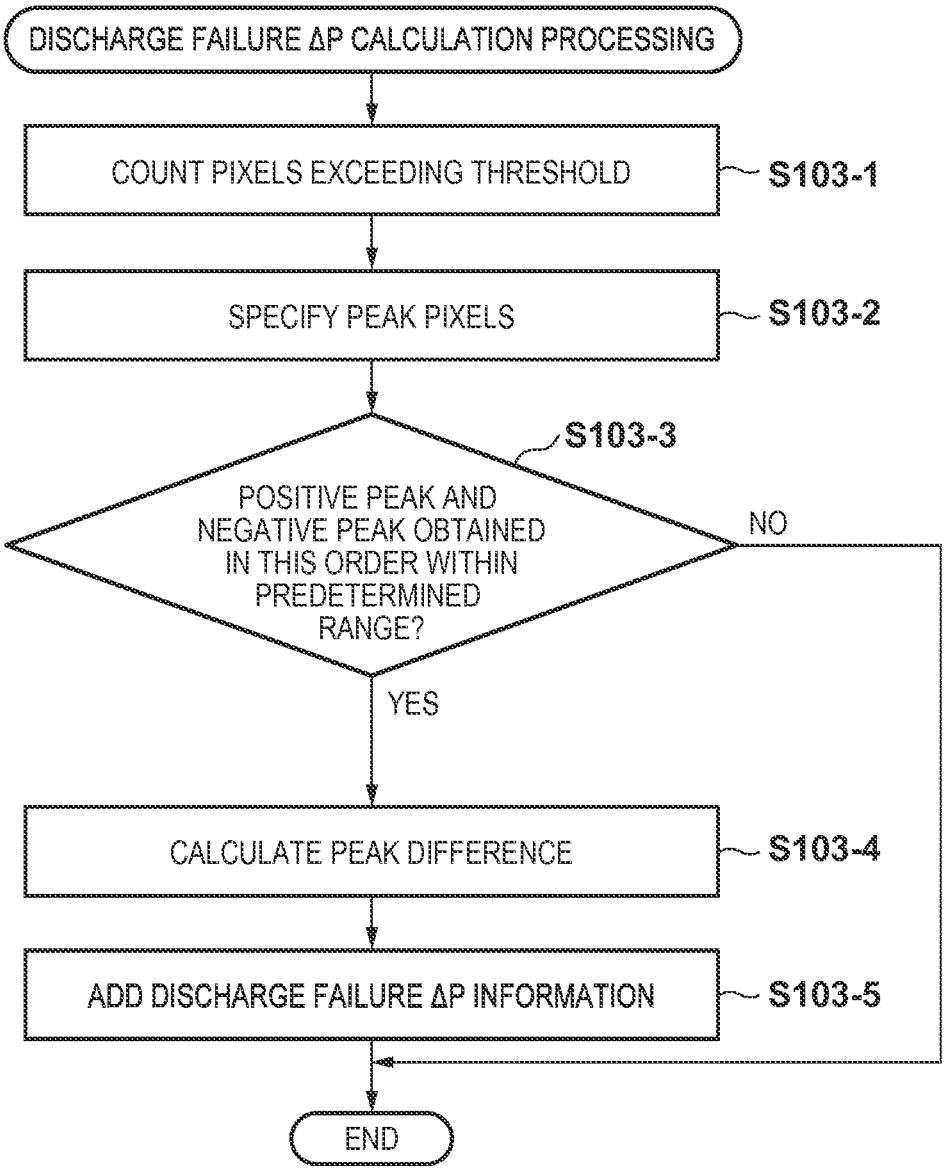
FIG. 16 is a flowchart for explaining discharge failure ΔP calculation processing.

FIG. 16 is a flowchart showing details of the discharge failure ΔP calculation processing. The discharge failure ΔP is calculated to specify the number of adjacent discharge failure nozzles.

Figure 17:
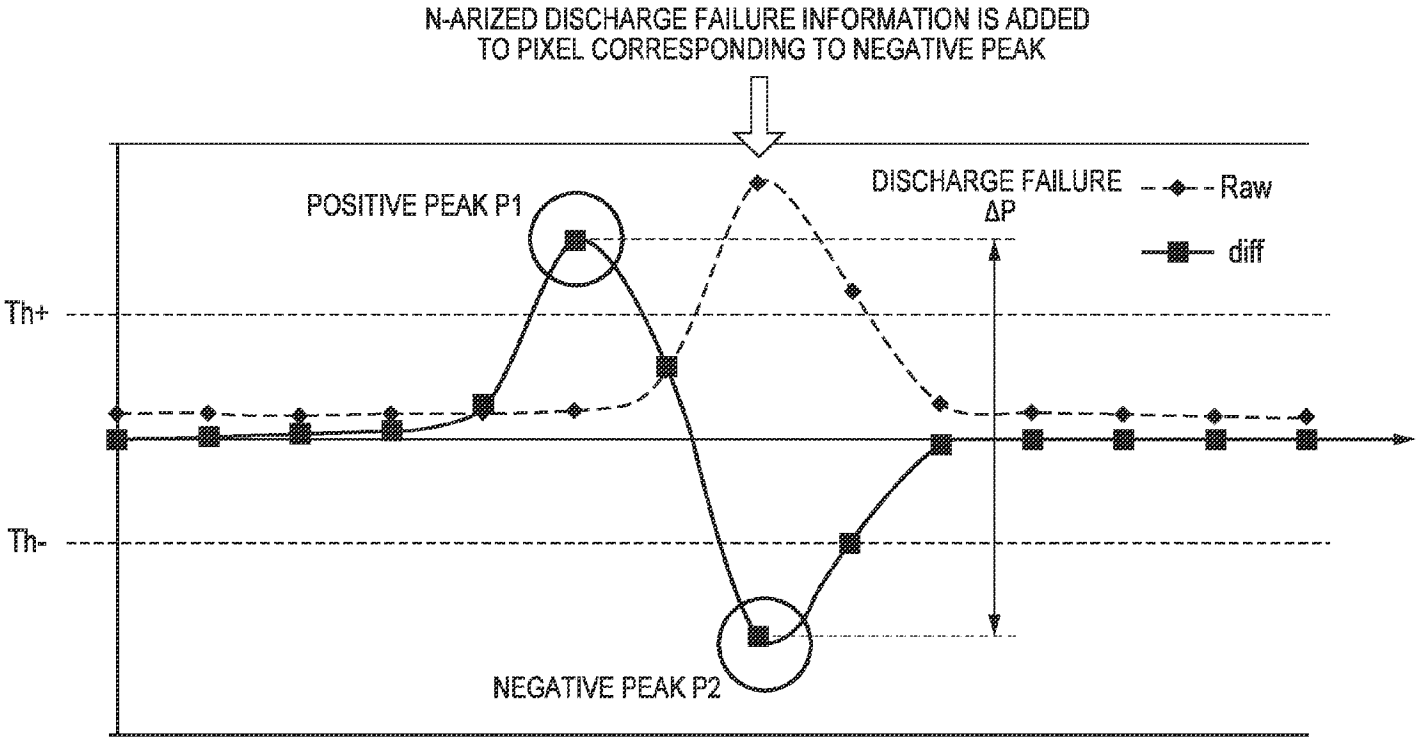
FIG. 17 is a graph for explaining an outline of the discharge failure ΔP.

FIG. 17 is a graph for explaining the relationship between the raw value, the differential value, and the discharge failure ΔP. In FIG. 17, "Th+" and "Th−" are positive and negative discharge failure detection start thresholds, "Raw" is the raw value calculated in step S101, and "diff" is the differential value calculated in step S102.

In step S103-1, pixels exceeding these thresholds are counted. That is, a pixel exceeding the positive threshold Th+ is searched for. If a pixel exceeding Th+ is detected, the local maximum value of a neighboring differential value is searched for in step S103-2, and this differential value is defined as a positive peak P1. Then, a pixel falling below Th− near the positive peak P1 is searched for. If a pixel falling below Th− is detected, the local minimum value of a neighboring differential value is searched for, and this differential value is defined as a negative peak P2. In this manner, peak pixels are specified. Note that Th+ and Th− can be desirably set in accordance with the ink type and the like.

In step S103-3, it is checked whether the positive peak and negative peak have been obtained in the ascending order of the position coordinate value within a predetermined range. If it is determined that both the positive peak and negative peak have been obtained in this order, it is determined that a discharge failure has occurred in a pixel near the negative peak, and the process advances to step S103-4 to calculate a peak difference value (P1−P2). In step S103-5, information of the discharge failure ΔP (=P1−P2) is added to the pixel corresponding to the negative peak.

The discharge failure ΔP is the peak difference of the differential value, and is defined as the difference between a positive local maximum value and a negative local minimum value in differential values. The discharge failure ΔP increases in proportion to the number of discharge failure nozzles, and thus can be used to estimate the number of nozzles having a discharge failure within pixels. In the embodiment, as a countermeasure against a detection error in discharge failure ΔP calculation, when the brightness of the raw value is equal to or higher than 80% of the average brightness value, discharge failure ΔP calculation is not executed. In this fashion, the raw value information may be used as a countermeasure against a detection error.

If it is determined that the positive peak and negative peak have not been obtained in this order, the process skips steps S103-4 and S103-5, and ends. The discharge failure ΔP calculation processing has been described.

Referring back to FIG. 14, N-arize processing is executed in step S104.

Figure 18:
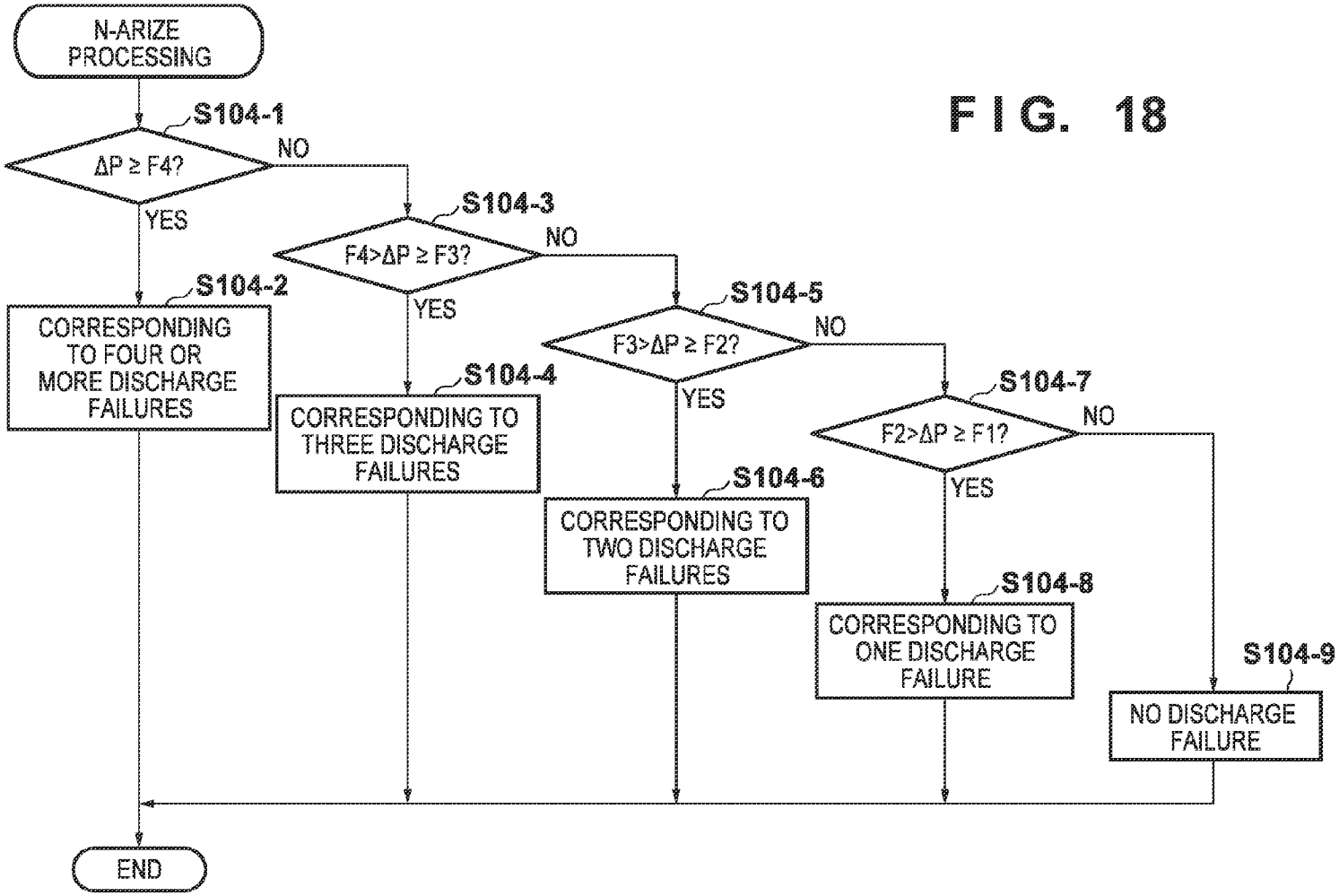
FIG. 18 is a flowchart showing N-arize processing.

FIG. 18 is a flowchart showing details of N-arize processing.

In this processing, the number of nozzles having a discharge failure within pixels is estimated from the discharge failure ΔP, and N-arization is performed. More specifically, the number of discharge failure nozzles within pixels is determined by comparing the discharge failure ΔP with preset discharge failure thresholds F1 to F4 (F4>F3>F2>F1).

In step S104-1 of FIG. 18, ΔP is compared with the threshold F4. If ΔP≥F4, the process advances to step S104-2 to determine that ΔP corresponds to four or more discharge failures. If F4>ΔP, the process advances to step S104-3 to compare ΔP with the threshold F3. If F4>ΔP≥F3, the process advances to step S104-4 to determine that ΔP corresponds to three discharge failures. If F3>ΔP, the process advances to step S104-5 to compare ΔP with the threshold F2.

If F3>ΔP≥F2, the process advances to step S104-6 to determine that ΔP corresponds to two discharge failures. If F2>ΔP, the process advances to step S104-7 to compare ΔP with the threshold F1. If F2>ΔP≥F1, the process advances to step S104-8 to determine that ΔP corresponds to one discharge failure. If F1>ΔP, the process advances to step S104-9 to determine that there is no discharge failure.

In this case, pentarization of ΔP corresponding to no discharge failure, ΔP corresponding to one discharge failure, ΔP corresponding to two discharge failures, ΔP corresponding to three discharge failure, and ΔP corresponding to four or more discharge failures has been exemplified. However, the present invention is not limited to this. The thresholds F1 to F4 can be optionally set. Here, the expression "corresponding to" one to four or more discharge failures is adapted to a case where when not a discharge failure but a deviation occurs, as described in step S1, if the deviation amount exceeds a predetermined value, it can be regarded as the discharge failure ΔP and handled similarly to the discharge failure.

Referring back to FIG. 14, in step S105, OK/NG determination is made for the discharge failure analysis. If the number of N-arized discharge failures falls within the acceptable range of the image quality, the discharge failure analysis is determined to be OK; if it falls outside the acceptable range, NG. In step S106, the discharge failure determination result in step S105 is saved in the memory. The discharge failure determination result to be saved includes the OK/NG determination result, and position information of a discharge failure obtained by the discharge failure analysis. In the embodiment, the discharge failure determination result is reset at the timing of the paper feed operation. The saved determination result is used in discharge failure type determination to be described below.

Discharge Failure Type Determination: Determination Unit (Step S72)

Next, discharge failure type determination in the analysis after discharge failure monitoring scan will be explained.

Figure 19:
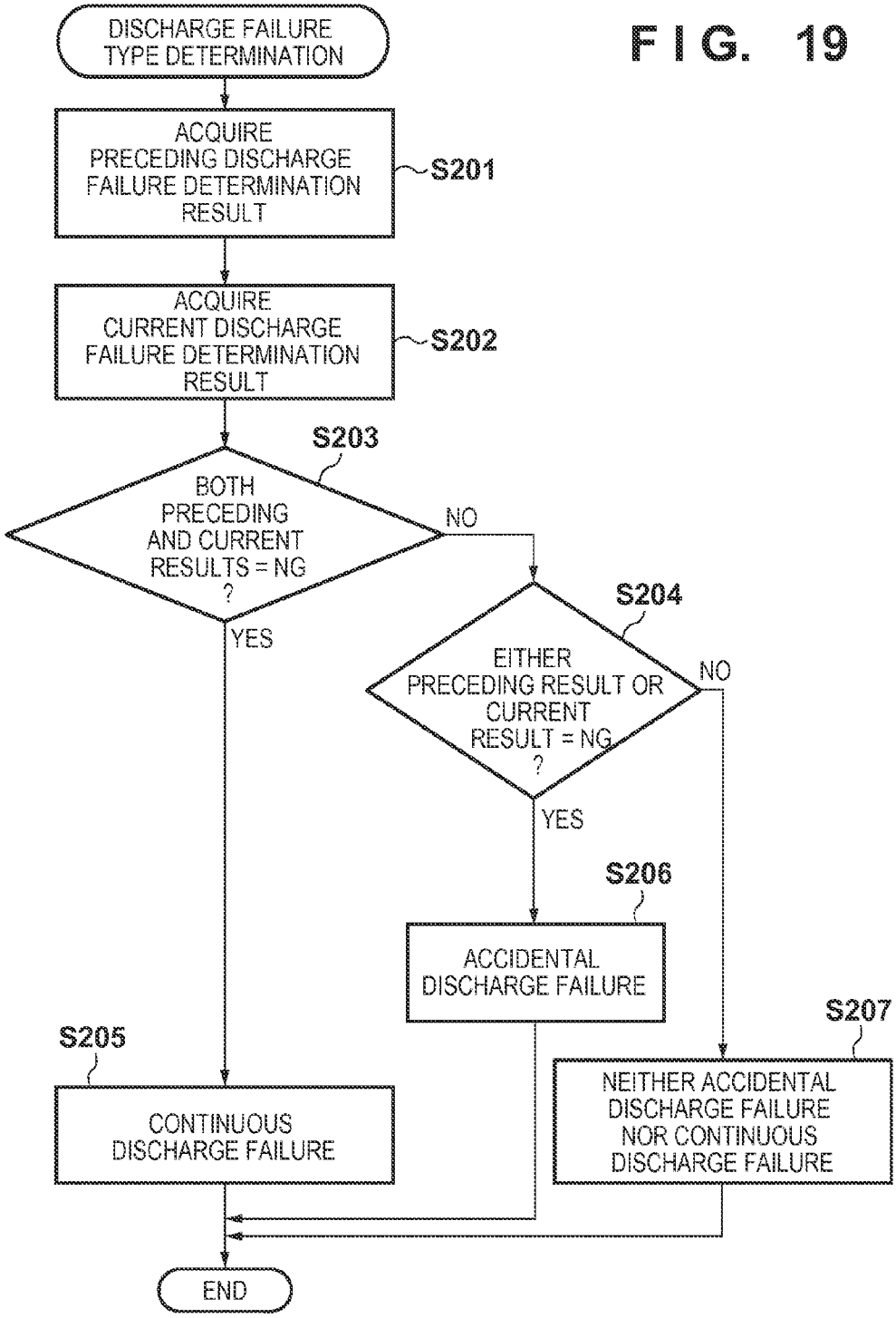
FIG. 19 is a flowchart showing discharge failure type determination processing according to the first embodiment.

FIG. 19 is a flowchart showing detailed processing of discharge failure type determination.

In step S201, a previous discharge failure determination result among determination results saved in step S106 is acquired. In step S202, the current discharge failure determination result is acquired.

In step S203, it is determined whether both the acquired previous and current determination results are NG. If these two determination results are NG, a discharge failure is highly likely to have occurred continuously, and the process advances to step S205 to determine "there is a continuous discharge failure". If either of the two determination results is not NG, the process advances to step S204 to determine whether either determination result is NG. If either determination result is NG, an accidental discharge failure is highly likely to have occurred, and the process advances to step S206 to determine "there is an accidental discharge failure". If neither the two acquired determination results are NG, the process advances to step S207 to determine "there is neither an accidental discharge failure nor continuous discharge failure".

Note that the above-described discharge failure type determination is performed for each ink color. If a continuous discharge failure or accidental discharge failure is detected for even one ink color used, the determination that there is either a continuous discharge failure or accidental discharge failure is made. However, if a continuous discharge failure is detected for a given ink and an accidental discharge failure is detected for another ink, it is determined that "there is a continuous discharge failure". To simplify the control, it is also possible to handle the discharge determination result of not each ink color but all the ink colors as OK/NG at once, and perform the discharge failure type determination.

According to the above-described embodiment, even when a discharge failure is detected during the printing operation, products printed in a state in which there is a continuous discharge failure, products printed in a state in which there is an accidental discharge failure, and products printed in a state other than these states are discharged to different discharge trays. In this manner, printed products with high image quality and printed products with poor image quality can be efficiently sorted.

The first embodiment has exemplified discharge to different discharge trays as a means for discriminating products printed in a state in which it is determined that there is a continuous discharge failure, products printed in a state in which it is determined that there is an accidental discharge failure, and products printed in a state other than these states. However, the present invention is not limited to this. For example, a position to which a printed product is discharged may be shifted in accordance with these three types of states, or printed products may be discriminated by, for example, notifying the user of the number of pages of a printed product for each of the above-mentioned states. In any case, it suffices to sort printed products so that the user can easily identify them.

Second Embodiment

The second embodiment will explain an example in which determination is made by checking discharge failure position information, in addition to the discharge failure analysis OK/NG determination result in the discharge failure type determination of the first embodiment.

Figure 20:
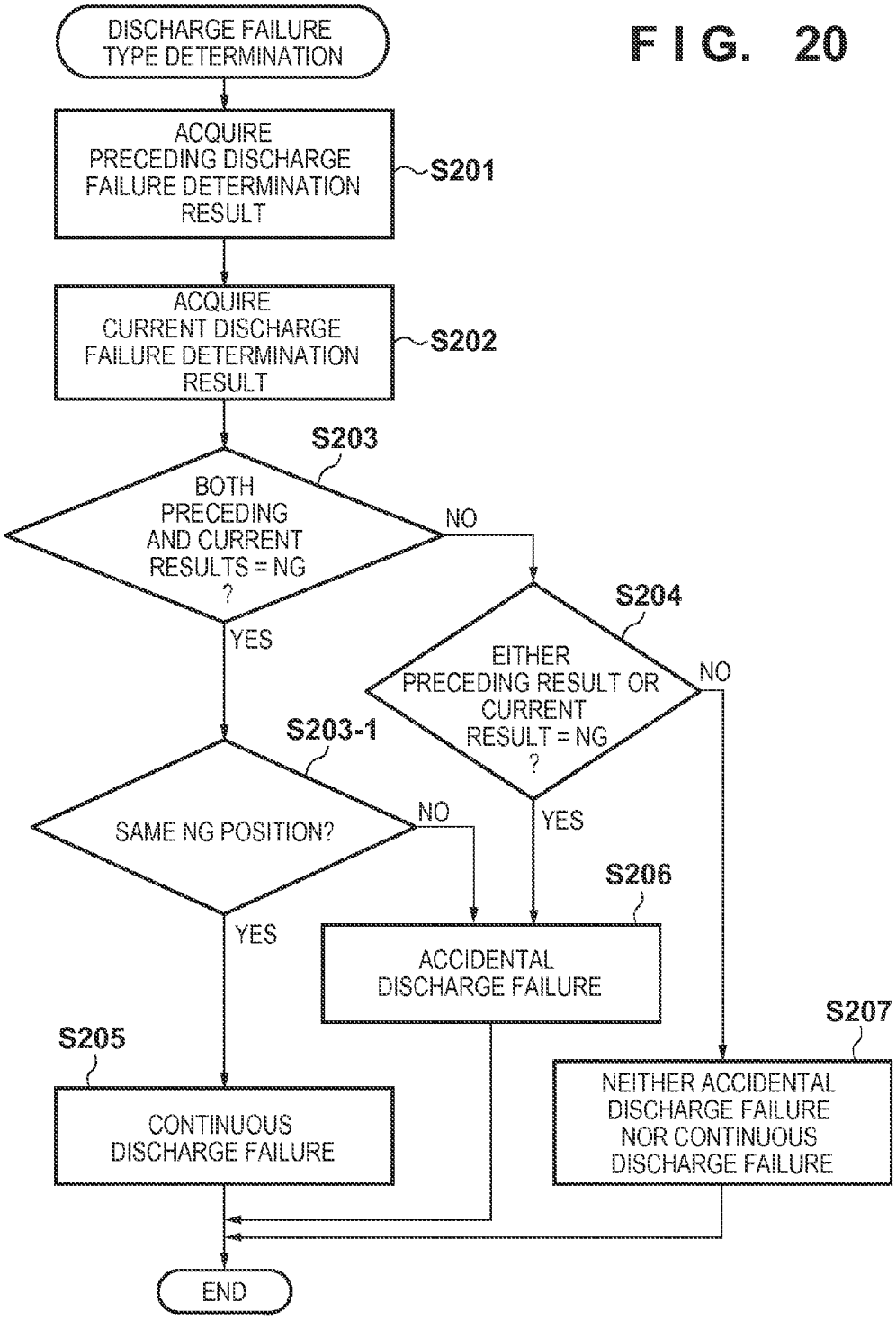
FIG. 20 is a flowchart showing discharge failure type determination processing according to the second embodiment.

FIG. 20 is a flowchart showing detailed processing of discharge failure type determination according to the second embodiment.

In FIG. 20, the same step reference symbols as those in FIG. 19 of the first embodiment denote the same processing steps, and a description thereof will not be repeated. Only processes unique to the second embodiment will be explained.

Similar to the first embodiment, the processes in steps S201 to S203 are executed. If it is determined in step S203 that both the acquired previous and current determination results are NG, the process advances to step S203-1. In step S203-1, it is determined whether these determination results "NG" have been detected at the same position. If these determination results "NG" have been detected at the same position, a discharge failure is highly likely to have occurred continuously, and the process advances to step S205 to determine "there is a continuous discharge failure". On the other hand, if these determination results "NG" have been detected at different positions, an accidental discharge failure is highly likely to have occurred, and the process advances to step S206 to determine "there is an accidental discharge failure".

The same position is defined as the range of a total of five pixels, that is, a pixel to which discharge failure information has been added in step S103-5 described in the first embodiment, and preceding two pixels and succeeding two pixels in the nozzle direction at a resolution of 400 dpi. The above definition "same position" is thus broadened in consideration of a reading error of the CCD line sensor, a position specifying error due to a lower reading resolution than the nozzle resolution, and the like. In the second embodiment, nozzles in the range of five pixels are defined as the same position. However, this range may be desirably set in accordance with the scanner resolution, the CCD line sensor accuracy, and the like.

According to the above-described embodiment, even when accidental discharge failures occur successively at different positions, a continuous discharge failure and accidental discharge failure can be discriminated more accurately by determining the discharge failure type by referring to discharge failure position information.

Third Embodiment

The third embodiment will describe an example in which when a discharge failure is detected, complementary printing for a discharge failure is performed while the printing operation continues. Complementary printing for a discharge failure can suppress a decrease in productivity caused by the stop of the apparatus, and increase the possibility of obtaining subsequent printed products at high quality.

Upon completion of complementary print processing for a discharge failure, high-quality printed products are highly likely to be output. However, it is difficult to accurately determine from where the high-quality printed product is and from where the high-quality printed product is branched to the corresponding discharge tray. Therefore, to simplify the control, the branch of the discharge tray does not depend on the completion timing of complementary print processing for a discharge failure, and complies with determinations 13*a* to 13*c* shown in FIG. 13 described in the first embodiment.

Figure 21:
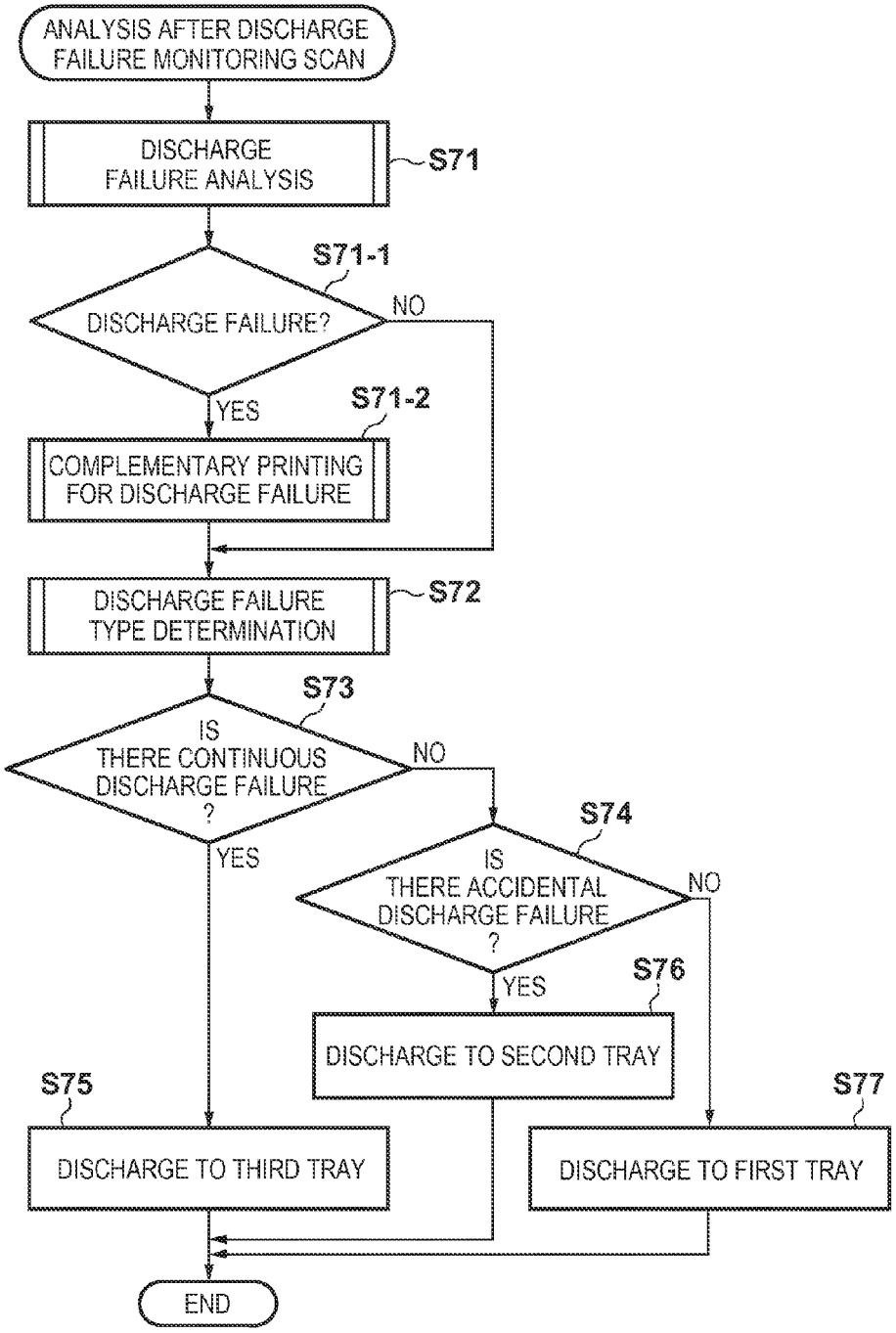
FIG. 21 is a flowchart showing analysis processing after discharge failure monitoring scan according to the third embodiment.

FIG. 21 is a flowchart showing details of analysis processing after discharge failure monitoring scan according to the third embodiment. In the flowchart shown in FIG. 21, the same step reference symbols as those in the flowchart of FIG. 12 denote the same processing steps, and a description thereof will not be repeated.

In the third embodiment, after discharge failure analysis in step S71, it is checked in step S71-1 whether there is a discharge failure. If it is determined that there is a discharge failure, the process advances to step S71-2 to perform complementary print for a discharge failure nozzle (complementary printing for a discharge failure). The process then advances to step S72 to execute the processing described in the first embodiment. If it is determined that there is no discharge failure, the process advances to step S72 to execute the processing described in the first embodiment.

If it is determined in step S73 that there is a continuous discharge failure, the ink discharge operation to sheets for images after the presence of the continuous discharge failure is determined may be stopped.

Part of an image after the presence of the continuous discharge failure is determined may have already been rasterized as image data in a print buffer (not shown). In this case, the ink discharge operation may be performed to a sheet using only the rasterized image data, and then the sheet may be cut by a cutter unit 6 and discharged. By performing the printing operation using the rasterized image data, even the blank portion of the sheet is conveyed to the downstream side of the printhead. The blank portion of the conveyed sheet is wound again. By doing so, even when the printing operation stops due to the discharge failure, the subsequent printing operation can start quickly, and the waste of the sheet can be prevented.

In the third embodiment, when it is determined that there is a continuous discharge failure, a printed product is discharged to the third tray. However, the discharge destination may be not the third tray, but the first or second tray in accordance with the setting of necessity of inspection based on discharge failure monitoring determination by the user. When it is set that inspection is necessary, re-print processing of printed products discharged to the third discharge tray can be automatically performed. In contrast, when it is set that the inspection is not necessary, all printed products may be initially handled as normal products. Also, when a discharge failure is determined but the user confirms that the printed product is a non-defective, re-print processing may not be automatically executed.

Next, the complementary printing for a discharge failure in step S71-2 will be explained.

In the complementary printing for a discharge failure, if a discharge failure is detected in the discharge failure analysis of step S71, complementary print is performed by allotting, to a nozzle not determined to have a discharge failure, print data of a nozzle (discharge failure nozzle) determined to have a discharge failure.

In the third embodiment, as is apparent from FIG. 5, four nozzle arrays are arranged for one ink color. Thus, even if a nozzle of a given array has a discharge failure, it can be complemented by effective nozzles of the remaining three arrays. All nozzles falling within the range of a total of five pixels, that is, a pixel to which discharge failure information has been added in step S103-5 of the first embodiment, and preceding two pixels and succeeding two pixels in the nozzle direction at a resolution of 400 dpi are set as discharge failure nozzles. The discharge failure setting range is set wide in consideration of a reading error of the CCD line sensor, a position specifying error due to a lower reading resolution than the nozzle resolution, and the like.

In the third embodiment, nozzles in the range of five pixels are set as discharge failure nozzles. However, this setting range may be desirably set in accordance with the scanner resolution, the CCD line sensor accuracy, and the like. Also, when a discharge failure is detected in step S71, complementary printing for a discharge failure may be performed regardless of whether the number of discharge failure nozzles is acceptable in terms of the image quality.

Figure 22:
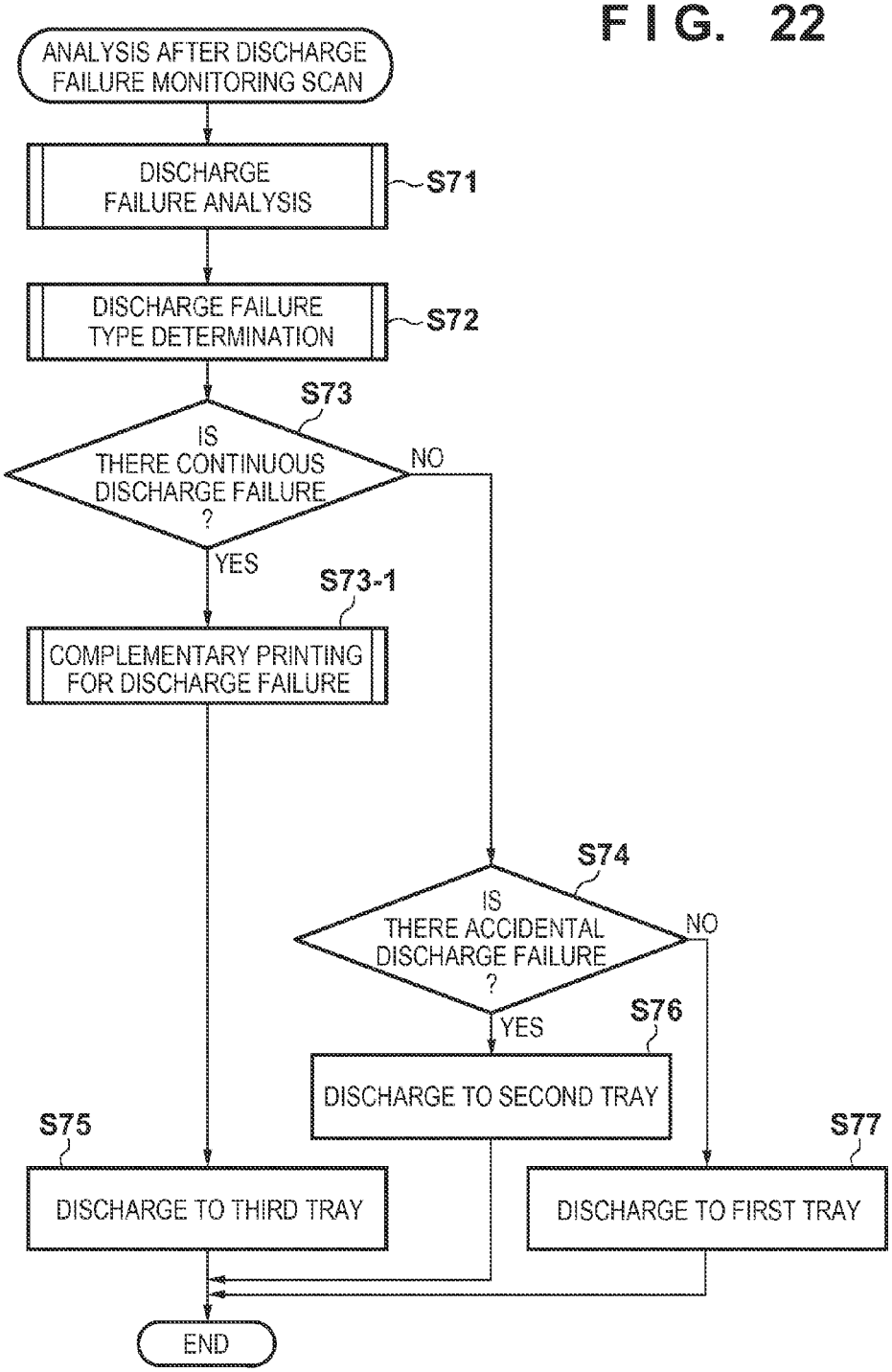
FIG. 22 is a flowchart showing analysis processing after discharge failure monitoring scan according to a modification of the third embodiment.

In the case of performing complementary printing for a discharge failure, it may be executed in step S73-1 only when it is determined in step S73 that the discharge failure is continuous, as in processing of a flowchart shown in FIG. 22. Since an accidental discharge failure is naturally recovered, complementary printing for a discharge failure is not performed for this discharge failure in the processing of FIG. 22. This can prevent a situation in which nozzles serving as complementary destinations run out when the number of nozzles determined to have a discharge failure increases.

According to the above-described embodiment, even when a discharge failure occurs during the printing operation, complementary printing for a discharge failure is performed while the printing operation continues. This can suppress a decrease in productivity caused by the stop of the apparatus, and increase the possibility of obtaining subsequent printed products at high quality.

Fourth Embodiment

The fourth embodiment will explain an example in which when it is determined that there is a continuous discharge failure, the printed product is discharged to the third tray, the printing operation is stopped to perform cleaning, and then the printing operation is restarted.

Figure 23:
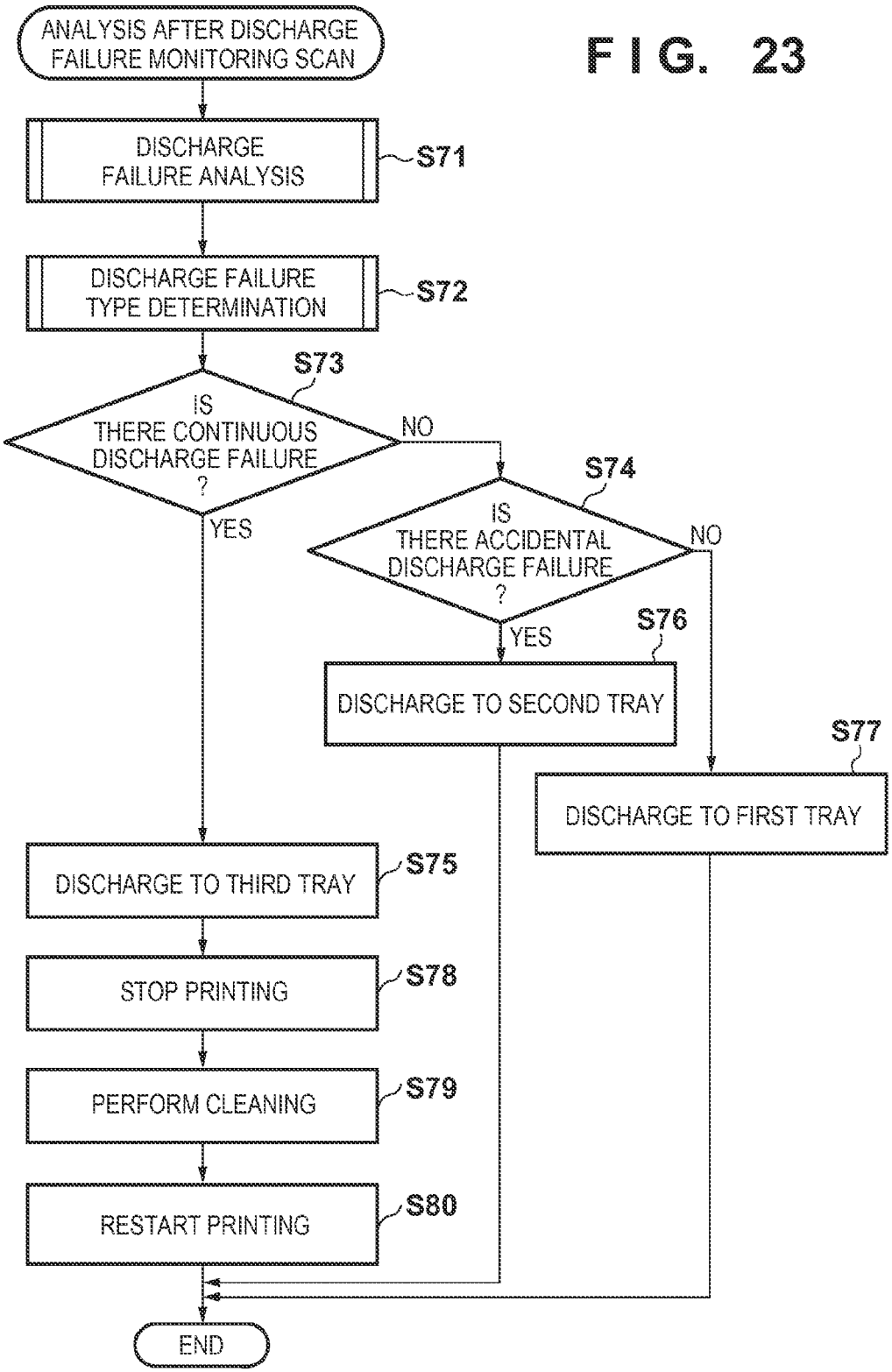
FIG. 23 is a flowchart showing analysis processing after discharge failure monitoring scan according to the fourth embodiment.

FIG. 23 is a flowchart showing analysis after discharge failure monitoring scan according to the fourth embodiment. In FIG. 23, the same step reference symbols as those in FIG. 12 denote the same processes, and a description thereof will not be repeated. Only processes unique to the fourth embodiment will be explained.

In the fourth embodiment, if there is a continuous discharge failure, the printed product is discharged to the third tray in step S75, and the printing operation is stopped in step S78. The printhead is cleaned in step S79, and the printing operation is restarted in step S80.

In cleaning in step S79, the face is wiped in a state in which a negative pressure is applied inside a suction port while the negative pressure is generated to a nozzle (suction wiping). The suction wiping can suck ink and dust attached near the nozzle port, and thus can remove a foreign substance at higher probability, compared to wiping using a blade. Although suction wiping is executed as the cleaning operation in the fourth embodiment, another operation such as blade wiping, suction recovery, or nozzle pressurization may be performed.

According to the above-described embodiment, even when a discharge failure is detected during the printing operation in a printing apparatus having no complementary printing function for a discharge failure, an unwanted stop of the apparatus arising from an accidental discharge failure can be avoided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-131391, filed Jun. 8, 2012, which is hereby incorporated by reference herein in its entirety.

What is claimed is:

1. A printing apparatus comprising:

a printhead having nozzles for printing a plurality of images and inspection patterns on a continuous print medium;

a reading unit configured to read and inspect the inspection patterns;

a cut unit configured to cut the continuous print medium on which the plurality of images are printed to form a print product;

a discharge unit configured to discharge the print product; and a control unit configured to, based on inspection results of two successive inspection patterns inspected by said reading unit, control said discharge unit to discharge the print product which is printed between the two successive inspection patterns discriminately from another print product.

2. The apparatus according to claim 1, wherein said control unit controls said discharge unit such that a first print product formed in a first case where no printing failure has occurred in both of the two successive inspection patterns, a second print product formed in a second case where printing failure has occurred in both of the two successive inspection patterns, and a third print product formed in a third case where printing failure has occurred in one of the two successive inspection patterns and no printing failure has occurred in the other of the two successive inspection patterns are discharged discriminately from each other.

3. The apparatus according to claim 2, further comprising:

a first tray to which the first print product formed in the first case is discharged;

a second tray to which the second print product formed in the second case is discharged; and a third tray to which the third print product formed in the third case is discharged.

4. The apparatus according to claim 2, further comprising a tray, wherein said control unit causes said discharge unit to discharge the first, second and third print products to discriminated positions on said tray in the first case, the second case, and the third case, respectively.

5. The apparatus according to claim 1, wherein said control unit is further configured to:

detect a discharge state of ink of the nozzles based on inspection results of said reading unit, and determine that a case where a number of nozzles where discharge failure has occurred is less than or equal to a threshold is no printing failure, and a case where a number of nozzles where discharge failure has occurred is more than the threshold is printing failure.

6. The apparatus according to claim 1, wherein said control unit is further configured to perform complementary printing based on inspection results of said reading unit.

7. A method for printing with a printhead for discharging ink, comprising:

printing a plurality of images and inspection patterns on a continuous print medium;

reading and inspecting the inspection patterns;

forming a print product by cutting the continuous print medium on which the plurality of images are printed; and discharging, based on inspection results of two successive inspection patterns, the print product which is printed between the two successive inspection patterns discriminately from another print product.

8. The method according to claim 7, wherein in a case where the print product formed between the two successive inspection patterns is discharged based on the inspection results of the two successive inspection patterns, a first print product formed in a first case where no printing failure has occurred in both of the two successive inspection patterns, a second print product formed in a second case where printing failure has occurred in both of the two successive inspection patterns, and a third print product formed in a third case where printing failure has occurred in one of the two successive inspection patterns and no printing failure has occurred in the other of the two successive inspection patterns, are discharged discriminately from each other.

9. A printing apparatus comprising:

a printhead having nozzles for printing a plurality of images and inspection patterns on a continuous print medium;

a reading unit configured to read and inspect the inspection patterns;

a cut unit configured to cut the continuous print medium on which the plurality of images are printed to form a print product; and a discharge unit configured to discharge the print product, wherein the discharge unit discharges the print product formed between two successive inspection patterns in a case where a result of inspecting the two successive inspection patterns is a first result discriminately from the print product formed between two successive inspection patterns in a case where the result of inspecting the two successive inspection patterns is a second result different from the first result.

10. The apparatus according to claim 9, further comprising a determination unit configured to determine that the result of inspecting the two successive inspection patterns is the first result in a case where no printing failure has occurred in both of the two successive inspection patterns, and determine that the result of inspecting the two successive inspection patterns is the second result in a case where printing failure has occurred in both of the two successive inspection patterns.

11. The apparatus according to claim 10, further comprising:

a first tray to which the print product is discharged in a case where the result of inspecting the two successive inspection patterns is the first result; and a second tray to which the print product is discharged in a case where the result of inspecting the two successive inspection patterns is the second result.

12. The apparatus according to claim 10, wherein said determination unit determines that the result of inspecting the two successive inspection patterns is a third result in a case where no printing failure has occurred in one of the two successive inspection patterns and printing failure has occurred in the other of the two successive inspection patterns, and said discharge unit discharges the print product in a case where the result of inspecting the two successive inspection patterns is the third result discriminately from the print product in a case where the result of the two successive inspection patterns is the second result.

13. The apparatus according to claim 12, further comprising a third tray to which the print product is discharged in a case where the result of inspecting the two successive inspection patterns is the third result.

14. The apparatus according to claim 10, further comprising a tray to which the print product in a case where the result of inspecting the two successive inspection patterns is the first result and the print product in a case where the result of inspecting the two successive inspection patterns is the second result are shifted from each other and discharged.

15. The apparatus according to claim 9, further comprising an inspection unit configured to detect discharge failure of the nozzles based on inspection results of said reading unit.

16. The apparatus according to claim 15, wherein said inspection unit determines that printing failure has occurred in a case where a number of the nozzles having the discharge failure exceeds a threshold.

17. The apparatus according to claim 16, wherein a complementary printing operation is performed in a case where said inspection unit determines that the printing failure has occurred.

18. The apparatus according to claim 16, further comprising a wiping unit configured to wipe a nozzle surface of the printhead, wherein said wiping unit wipes the nozzle surface of the printhead in a case where said inspection unit determines that the printing failure has occurred.

19. A printing apparatus comprising:

a printhead having nozzles for printing a plurality of images and inspection patterns on a print medium;

a reading unit configured to read and inspect the inspection patterns; and a discharge unit configured to discharge the print medium which has been printed, wherein the discharge unit discharges the print medium which has been printed between two successive inspection patterns in a case where a result of inspecting the two successive inspection patterns is a first result discriminately from the print medium which has been printed between two successive inspection patterns in a case where the result of inspecting the two successive inspection patterns is a second result different from the first result.

20. A print product processing apparatus comprising:

a reading unit configured to read and inspect inspection patterns printed on a continuous print medium;

a cut unit configured to cut the continuous print medium on which a plurality of images are printed to form a print product; and a discharge unit configured to discharge the print product, wherein the discharge unit discharges the print product formed between two successive inspection patterns in a case where a result of inspecting the two successive inspection patterns is a first result discriminately from the print product formed between two successive inspection patterns in a case where the result of inspecting the two successive inspection patterns is a second result different from the first result.

* * * * *